US005672573A

United States Patent [19]

Gutierrez et al.

[11] Patent Number: 5,672,573

[45] Date of Patent: Sep. 30, 1997

[54] AMICLOAMINE DERIVATIVES OF CARBOXYLIC AND THIOCARBOXYLIC-FUNCTIONALIZED HYDROCARBON POLYMERS

[75] Inventors: Antonio Gutierrez, Mercerville; James P. Stokes, Warren, both of N.J.

[73] Assignee: Exxon Chemical Patents Inc., Linden, N.J.

[21] Appl. No.: 630,055

[22] Filed: Apr. 10, 1996

[51] Int. Cl.[6] ..... C10M 149/18

[52] U.S. Cl. ..... 508/554; 508/551; 508/555; 508/476; 508/477; 525/327.6

[58] Field of Search ..... 508/554, 476, 508/477

[56] References Cited

U.S. PATENT DOCUMENTS

| | | | |
|---|---|---|---|
| 2,830,954 | 4/1958 | Dixon | 508/554 |
| 3,448,049 | 6/1969 | Preuss et al. | 508/477 |
| 3,715,313 | 2/1973 | Haseltine, Jr. et al. | 252/73 |
| 3,857,791 | 12/1974 | Marcellis et al. | 508/554 |
| 4,088,588 | 5/1978 | Pecoraro | 252/51.5 A |
| 4,857,217 | 8/1989 | Gutierrez et al. | 252/47 |
| 4,938,885 | 7/1990 | Migdal | 252/51.5 A |
| 4,956,107 | 9/1990 | Gutierrez et al. | 252/47 |
| 4,963,275 | 10/1990 | Gutierrez et al. | 252/47 |
| 5,023,283 | 6/1991 | Ravichandran et al. | 508/477 |
| 5,034,018 | 7/1991 | Gutierrez et al. | 44/331 |
| 5,229,020 | 7/1993 | Gutierrez et al. | 252/51.5 A |
| 5,304,315 | 4/1994 | Stover | 508/554 |
| 5,395,539 | 3/1995 | Chandler et al. | 508/554 |
| 5,397,489 | 3/1995 | Carlisle | 508/476 |
| 5,425,888 | 6/1995 | Santambrogio et al. | 508/554 |

FOREIGN PATENT DOCUMENTS

| | | |
|---|---|---|
| 2110871 | 6/1994 | Canada . |
| 0400874 | 12/1990 | European Pat. Off. . |

OTHER PUBLICATIONS

Research Disclosure —Jul. 1995, 37537, Dispersants for Fuel and Lube Applications, p. 486.

*Primary Examiner*—Ellen M. McAvo
*Attorney, Agent, or Firm*—K. R. Walton

[57] ABSTRACT

Processes for preparing amidoamine products derived from hydrocarbon polymers containing carboxylic acid, thioacid, ester or thioester functional groups are disclosed. More particularly, a process is disclosed which comprises the steps of:

(A) reacting (i) a hydrocarbon polymer functionalized to contain functional groups of formula —CO—Y—$R^3$, the hydrocarbon polymer having a number average molecular weight of at least about 500 prior to functionalization, wherein Y is O or S, $R^3$ is hydrogen, hydrocarbyl, or substituted hydrocarbyl and wherein at least 50 mole % of the functional groups are attached to a tertiary carbon atom of the polymer, with (ii) a volatile amine containing at least two reactive amino groups under conditions effective to amidate at least a portion of the —CO—Y—$R^3$ functional groups and form a first amidoamine adduct containing at least one reactive amino group; and (B) reacting the first amidoamine adduct with an α,β-unsaturated compound to form a second amidoamine adduct, wherein the α,β-unsaturated compound has the formula:

$$R^4-\overset{R^5}{\overset{|}{C}}=\overset{R^6}{\overset{|}{C}}-\overset{X}{\overset{\|}{C}}-Z \qquad (I)$$

wherein X is O or S; Z is $OR^7$, —$SR^7$, or —$NR^7(R^8)$; and $R^4$, $R^5$, $R^6$, $R^7$ and $R^8$ are the same or different and are hydrogen, hydrocarbyl, or substituted hydrocarbyl. In reaction step (B), the reactive amino groups in the first amidoamine adducts react non-selectively with both the carbon—carbon double bonds and the —C(=X)Z functional groups in the unsaturated compounds or, with suitable control of the reaction conditions, react selectively with the carbon—carbon double bonds only. In the case of selective reaction, the second amidoamine adduct is characterized by having unreacted —C(=X)Z functional groups, and the adduct can be further reacted with a second amine in order to amidate the —C(=X)Z functional groups. The amidoamine products are useful as additives in fuels and lubricating oils.

31 Claims, No Drawings

AMICLOAMINE DERIVATIVES OF CARBOXYLIC AND THIOCARBOXYLIC-FUNCTIONALIZED HYDROCARBON POLYMERS

FIELD OF THE INVENTION

This invention relates to processes for preparing amidoamine products derived from functionalized hydrocarbon polymers and the products resulting from such processes. The amidoamine products are useful as additives (e.g., dispersants) in lubricating oils and in fuels.

BACKGROUND OF THE INVENTION

U.S. Ser. No. 534,891, filed Sep. 25, 1995, which is a continuation of U.S. Ser. No. 992,403, filed Dec. 17, 1992, abandoned, discloses the reaction of polymers having a number average molecular weight ("$\overline{M}_n$") of at least 500 and having at least one ethylenic double bond via a Koch mechanism to form functionalized polymers containing (thio)carboxylic acid or ester groups. U.S. Ser. No. '891 discloses that the functionalized polymers can contain neo substituted acid or ester functional groups. U.S. Ser. No. '891 further discloses derivatizing the functionalized polymers by reaction with an amidoamine adduct formed by the non-selective reaction of a polyamine such as tetraethylene pentamine with an α, β-unsaturated compound such as methyl methacrylate.

Hydrocarbon polymers functionalized to contain a substantial proportion of neo substituted (thio)carboxylic acid or ester groups (e.g., 50 mole % or more of neo —CO—YK$^3$ functional groups) tend to be chemically stable and difficult to react with nucleophilic compounds (e.g., monoamines, polyamines, polyhydric alcohols, and the like) in comparison to similar or analogous functionalized polymers having little or no neo functional group content (e.g., polyolefin substituted mono- and dicarboxylic acids such as polyisobutenyl succinic acids or anhydrides and polyisobutenyl propionic acids). This chemical stability is believed to be due at least in part to steric factors. More particularly, the reaction of hydrocarbon polymers containing neo carboxylic acid or ester groups with amidoamines prepared from polyamines and α,β-unsaturated compounds as disclosed in U.S. Ser. No. '891 will typically not proceed or will proceed only slowly and with low yields at temperatures ranging up to about 150° to 180° C. In contrast, low neo content carboxylic acid- and ester-functionalized polymers typically react to high yields at temperatures below 150° C. (e.g., 80° to 150° C.). Reacting the neo functionalized polymer and the amidoamines at temperatures above about 180° C. and particularly above 200° C. (e.g., 220° to 260° C.) will accelerate the reaction rate, but, because these amidoamines are normally not stable at these high temperatures, will also cause the amidoamine reactant and the amidoamine moiety in any resulting product to decompose with a loss of nitrogen and the formation of insoluble byproducts. The reaction of the functionalized polymer and the amidoamine is a second order reaction, so that an excess of amidoamine can be employed at lower reaction temperatures to achieve satisfactory conversion in reasonable reaction times. This results, however, in a product mixture containing unreacted amidoamine having unreacted amino groups within its structure, which represents a loss of valuable reactant and whose presence can be detrimental in certain applications such as dispersant applications involving contact with elastomer seals. Separation of the unreacted amidoamine from the product can be difficult or expensive; e.g., these amidoamines can have low volatility making removal by distillation or stripping impractical. In summary, the direct reaction of neo-functionalized polymer with amidoamines, such as those disclosed in U.S. Ser. No. '891, is normally impractical, resulting in (i) little or no yield of the desired amidoamine functionalized polymer adduct and/or (ii) a product mixture containing substantial amounts of wasted amidoamine reactant.

SUMMARY OF THE INVENTION

The present invention is directed to processes for preparing amidoamine products derived from hydrocarbon polymers containing carboxylic acid, thiocarboxylic acid, ester or thioester functional groups. More particularly, the invention includes a process for preparing a product useful as an additive in lubricating oils and in fuels comprising the steps of:

(A) reacting (i) a hydrocarbon polymer functionalized to contain functional groups of formula —CO—Y—R$^3$, the hydrocarbon polymer having a number average molecular weight of at least about 500 prior to functionalization, wherein Y is O or S, R$^3$ is hydrogen, hydrocarbyl, or substituted hydrocarbyl and wherein at least 50 mole % of the functional groups are attached to a tertiary carbon atom of the polymer, with (ii) a volatile amine containing at least two reactive amino groups under conditions effective to amidate at least a portion of the —CO—Y—R$^3$ functional groups and form a first amidoamine adduct containing at least one reactive amino group; and (B) reacting the first amidoamine adduct with an α,β-unsaturated compound to form a second amidoamine adduct, wherein the α,β-unsaturated compound has the formula:

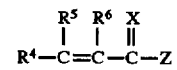

(I)

wherein X is O or S; Z is OR$^7$, —SR$^7$, or —NR$^7$(R$^8$); and R$^4$, R$^5$, R$^6$, R$^7$ and R$^8$ are the same or different and are hydrogen, hydrocarbyl, or substituted hydrocarbyl.

In one embodiment of the process of the invention, the volatile amine of step (A) is employed in an amount of at least 1 mole per equivalent of functional groups in the functionalized hydrocarbon polymer, and is more preferably employed in an excess molar amount.

In another embodiment, the α, β-unsaturated compound in step (B) is employed under conditions effective to selectively react at least a portion of the carbon—carbon double bonds in the α,β-unsaturated compound with the reactive amino groups in the first amidoamine adduct, such that the second amidoamine adduct is characterized by having unreacted —C(=X)Z functional groups. In still another embodiment, the process of the invention further comprises the step of reacting the second amidoamine adduct obtained by the selective reaction of the α,β-unsaturated compound with a second amine under conditions effective to amidate at least a portion of the —C(=X)Z functional groups in the second amidoamine adduct.

Reacting the relatively stable neo functionalized polymer with a volatile amine (i.e., reaction step (A) above) solves the problem of low yields and/or product decomposition characteristic of the direct reaction of neofunctionalized hydrocarbon polymers with amidoamines. Relative to amidoamines such as those disclosed in U.S. Ser. No. '891, the volatile amine typically possesses greater thermal stability; i.e., the volatile amine can react with neofunctionalized hydrocarbon polymers at more extreme reaction temperatures (e.g., greater than about 180° C.) to achieve significant conversions of the functionalized polymer without an accompanying loss of the amine reactant due to thermal decomposition. The amidated product obtained from the volatile amine and the functionalized polymer is also stable at more extreme reaction temperatures and thus less subject to product loss due to thermal decomposition, in comparison to products obtained by direct reaction of the polymer with known amidoamines. In addition, the volatile amine can be used in a substantial excess in these second order reactions to obtain high conversions at reduced reaction times and thereby avoid prolonged exposure of the reactants and products to high temperatures. Alternatively, a substantial excess of the volatile amine can be employed to obtain high conversions at reduced reaction temperatures (e.g., less than about 180° C.) in reasonable reaction times (e.g., 2 to 10 hours), and thereby avoid the possibility of thermal decomposition altogether. Furthermore, at the conclusion of reaction step (A), any unreacted volatile amine can be conveniently removed (e.g., by inert gas stripping or by distillation) to avoid interference of the amine with subsequent reaction and treatment steps, and can be recycled for use as a reactant. The amidoamine adduct resulting from step (A) can then be further reacted in step (B) with an α,β-unsaturated compound to obtain good yields of a second amidoamine adduct (which, in the case of selective reaction in step (B), can optionally be further reacted with a second amine), which is useful as an additive (e.g., a dispersant or detergent) in fuels and lubricating oils.

The invention includes products of the above-described processes involving selective reaction of the first amidoamine adduct with the α,β-unsaturated compound of formula (I). More particularly, the product of the invention includes a product comprising the second amidoamine adduct obtained by selective reaction of the first amidoamine adduct formed in reaction step (A) with the α,β-unsaturated compound of formula (I). In one embodiment, this product comprises the second amidoamine adduct further reacted with a second amine such that at least a portion of the —C(=X)Z groups in the second amidoamine adduct are amidated.

The foregoing aspects and other aspects of the invention are more fully described below.

As used herein, the term "hydrocarbyl" refers to a radical having a carbon atom directly attached to the remainder of the molecule and consisting predominantly of carbon atoms and hydrogen atoms. Hydrocarbyl radicals include aliphatic hydrocarbyl groups (e.g., alkyl or alkenyl), alicyclic hydrocarbyl (e.g., cycloalkyl or cycloalkenyl), aromatic hydrocarbyl, aliphatic- and alicyclic-substituted aromatic, aromatic substituted aliphatic and alicyclic, and the like. The hydrocarbyl radical can contain non-hydrocarbon substituents (e.g., halo, hydroxy, alkoxy, etc.), but only to the extent they do not alter the predominantly hydrocarbon character of the radical. Any hydrocarbyl radical containing aromatic is broadly referred to herein as "aryl".

The term "substituted hydrocarbyl" as used herein refers to a radical having a carbon atom directly attached to the remainder of the molecule, wherein the character of the radical is not predominantly hydrocarbon due to the presence of non-hydrocarbon substituents, such as those noted above in describing "hydrocarbyl". Any substituted hydrocarbyl radical containing aromatic is broadly referred to herein as "substituted aryl".

The term "amidoamine" herein refers to a reaction product containing at least one amido linkage (i.e., —C(=O)—N<) and at least one amino group (i.e., at least one primary, secondary or tertiary amino group). Unless otherwise stated or clear from the context, the term "amidoamine" is also used broadly to refer to a reaction product containing at least one thio-amidoamine linkage ((—C(=S)—N<) and at least one amino group.

DETAILED DESCRIPTION OF THE INVENTION

Functionalized Polymer

The functionalized hydrocarbon polymer employed in the present invention is a hydrocarbon polymer in which functionalization is by attachment of groups of formula:

$$-\overset{\overset{\displaystyle O}{\|}}{C}-Y-R^3 \qquad \text{(II)}$$

wherein Y is O or S, and $R^3$ is H, hydrocarbyl, or substituted hydrocarbyl and at least 50 mole % of the functional groups are attached to a tertiary carbon atom of the polymer (i.e., at least 50 mole % of the functional groups are "neo" groups). $R^3$ is preferably aryl or substituted hydrocarbyl, and more preferably aryl or substituted aryl.

Thus the functionalized polymer may be depicted by the formula:

$$\text{POLY}\left(\begin{array}{c} R^1 \\ | \\ C \\ | \\ R^2 \end{array}-CO-Y-R^3\right)_n \qquad \text{(III)}$$

wherein POLY is a backbone derived from a hydrocarbon polymer having a number average molecular weight of at least 500; n is a number greater than 0; $R^1$ and $R^2$ are independently the same or different and are each H, hydrocarbyl, or polymeric hydrocarbyl with the proviso that $R^1$ and $R^2$ are selected such that in at least 50 mole % of the $—CR^1R^2—$ groups both $R^1$ and $R^2$ are not H (i.e., at least 50 mole % of the —CO—Y—$R^3$ groups are "neo" groups); and $R^3$ is as defined in the preceding paragraph. The term "polymeric hydrocarbyl" refers to a radical derived from the hydrocarbon polymer which can contain non-hydrocarbon substituents provided the radical is predominantly hydrocarbon in character.

The subscript n in Formula (III) represents the functionality of the functionalized hydrocarbon polymer; i.e., n is the average number of functional groups per polymer chain. Alternatively expressed, n is the average number of moles of functional groups per "mole of polymer", wherein "mole of polymer" refers to the moles of starting hydrocarbon polymer used in the functionalization reaction and therefore includes both functionalized and unfunctionalized polymer. Accordingly, the functionalized hydrocarbon polymer product can include molecules having no functional groups. n can be determined by carbon-13 NMR. Specific preferred embodiments of n include $1 \geqq n \geqq 0$; $2 \geqq n \geqq 1$; and $n \geqq 2$. The optimum number of functional groups needed for desired performance of the amidoamine products of the invention will typically increase with polymer $\overline{M}_n$. For functionalized hydrocarbon polymer prepared using Koch chemistry as described below, the maximum value of n will be determined by the average number of double bonds per polymer chain in the polymer prior to functionalization.

As described below, the —$YR^3$ group in formulas (II) and (III) has a corresponding acidic species $HYR^3$ which can be employed as a trapping agent in a Koch reaction for preparing the functionalized hydrocarbon polymer. The —$YR^3$ moiety is also a "leaving" group in the amidation of the functionalized hydrocarbon polymer with a volatile amine, thereby forming $HYR^3$ as a byproduct. In a preferred embodiment, $—YR^3$ has a $pK_a$ of less than or equal to about 12, preferably less than about 10, and more preferably less than about 8. The $pK_a$ is determined from the corresponding acidic species $HYR^3$ in water at 25° C. This embodiment has been found to be more reactive towards amidation.

The functionalized hydrocarbon polymers are predominately "neo" functionalized polymers. The functionalized polymer has at least 50, preferably at least 60, and more preferably at least 80 mole percent neo functional groups. The polymer can have at least 90 mole percent neo functional groups, and can have 99 and even 100 mole percent neo groups. The content of neo functional groups in the functionalized polymer can be determined using carbon-13 NMR. The neo functionalized polymers are generally more stable and less reactive (e.g., with nucleophilic compounds such as monoamines, polyamines, monoalcohols, polyols, and so forth) than similar polymers with little or no neo content; e.g., polymers containing a high content of iso functional groups.

In one embodiment of the functionalized polymer defined by formula (III), Y is O (oxygen), and $R^1$ and $R^2$ are the same or different and are selected from H, a hydrocarbyl group, and a polymeric hydrocarbyl group.

In another embodiment Y is O or S; $R^1$ and $R^2$ are the same or different and are selected from H, a hydrocarbyl group, a substituted hydrocarbyl group and a polymeric hydrocarbyl group; and $R^3$ is selected from an aromatic group (i.e., an aryl group) and a substituted hydrocarbyl group, or from an aryl group and a substituted aromatic group (i.e., a substituted aryl group). This embodiment is generally more reactive towards derivatization with amines of the present invention especially where the $R^3$ substituent contains electron withdrawing species. A preferred leaving group, $—YR^3$, for this embodiment has a corresponding acidic species $HYR^3$ with a pKa of less than 12, preferably less than 10 and more preferably 8 or less. pKa values can range typically from 5 to 12, preferably from 6 to 10, and most preferably from 6 to 8. The pKa of the leaving group determines how readily the functionalized hydrocarbon polymer will react to produce amidoamine derivatives.

In one preferred embodiment, Y is O, and $R^3$ has the formula:

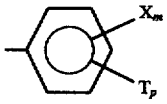

(IV)

wherein X, each of which are the same or different, is an electron withdrawing group; T, each of which are the same or different, is a non-electron withdrawing group (e.g., electron donating); m and p are integers from 0 to 5. Preferably, m is from 1 to 5, and more preferably 1 to 3. Preferably, p is from 0 to 2, and more preferably 0 to 1. X is preferably selected from a halogen (especially F or Cl), $CF_3$, CN, and $NO_2$. T is preferably selected from alkyl, especially $C_1$ to $C_6$ alkyl, and most especially methyl or ethyl.

Among the suitable $R^3$ groups represented by formula (IV) are halophenyls, such as chlorophenyl, fluorophenyl, difluorophenyl, dichlorophenyl, and alkylchlorophenyl (e.g., methylchlorophenyl), and the like. 2,4-Dichlorophenyl and 2-chloro-4-methylphenyl are preferred, and 2-chloro-4-methylphenyl is most preferred. Accordingly, substituted aryl ester functional groups are difluorophenyl ester, dichlorophenyl ester, and methylchlorophenyl ester. 2,4-dichlorophenyl ester and 2-chloro-4-methylphenyl ester are preferred aryl ester functional groups.

In another preferred embodiment, Y is O and $R^3$ is a substituted hydrocarbyl group which is a substituted alkyl group having 2 to 8 (preferably 2 to 4) carbon atoms and containing at least one (preferably at least two) electron withdrawing substituent groups. The electron withdrawing substituent groups are preferably halogen, more preferably F or Cl or combinations thereof, and most preferably F. Other electron withdrawing substituent groups, such as $NO_2$ or CN, are also suitable, both independently and in combination with halogen groups and/or with each other. The substituted alkyl group can contain electron withdrawing substituent groups on any one of the carbon atoms of the alkyl group, or all of the carbon atoms, or any combination thereof, provided that the corresponding alcohol $H—O—R^3$ is chemically stable under the conditions employed in preparing the amidoamine products of the invention, as described below.

The substituted alkyl groups are conveniently haloalkyl groups (which includes, for example, $C_2$ to $C_8$ monohalo- and polyhaloalkyl groups), especially polyhaloalkyl groups (e.g., polychloroalkyl and polyfluoroalkyl groups), and most especially polyfluoroalkyl groups (e.g., $C_2$ to $C_8$ polyfluoroalkyl groups). Preferred polyhaloalkyl groups are those having at least one, and preferably more than one, halogen substituent on the beta carbon atom (or atoms) in the alkyl group. Suitable polyhaloalkyl groups include, but are not limited to 2,2-difluoroethyl; 2,2,2-trifluoroethyl; 2,2-dichloroethyl; 2,2,2-trichloroethyl; 1,1,1-trifluoroisopropyl; 1,1,1,3,3,3-hexafluoroisopropyl (alternatively referred to herein simply as hexafluoroisopropyl); 2,2,3,3,3-pentafluoropropyl; 2- methylhexafluoro-2-propyl and 2-trifluoromethylhexafluoro-2-propyl. A particularly suitable polyhaloalkyl group is hexafluoroisopropyl. Accordingly, a particularly suitable polyhaloalkyl ester functional group is hexafluoroisopropyl ester.

The functionalized hydrocarbon polymers can be prepared using the Koch reaction. In the Koch process, a hydrocarbon polymer containing at least one carbon—carbon double bond is selectively functionalized at at least a portion of the double bond sites by contacting the polymer with carbon monoxide and a Koch catalyst, which is preferably a classical Broensted acid or a Lewis acid catalyst. The Koch reaction is conducted in a manner and under conditions such that an acylium cation is formed at the site of a carbon—carbon double bond wherein the acylium ion is in turn reacted with a nucleophilic trapping agent selected from the group consisting of water, $H_2S$, or at least one hydroxy or thiol containing compound, wherein water forms a carboxylic acid, $H_2S$ forms a thiocarboxylic acid (i.e., —C(=O)SH), a hydroxy-containing compound forms a carboxylic ester, and a thiol-containing compound forms a thio-carboxylic ester. The trapping agent has the formula $HYR^3$ wherein Y and $R^3$ are as defined above. Preferred trapping agents correspond to the acidic species $HYR^3$ of the preferred $—YR^3$ groups as described above.

In the Koch process, (thio)carboxylic acid or (thio) carboxylic ester can be formed at moderate temperatures and pressures at the point of unsaturation of the hydrocarbon polymer. The polymer is maintained in a desired temperature range which is typically between −20° to 200° C. and preferably from 0° to 80° C. The pressure in the reactor can be maintained based on the CO source, with pressures up to 34,500 pKa (5,000 psig) with a preferred range of from 3,450 to 20,700 pKa (500 to 3,000 psig).

The relative amounts of reactants and catalyst and the reaction conditions are controlled in a manner sufficient to functionalize typically at least about 40, preferably at least 80, more preferably at least 90, and most preferably at least 95 mole % of the carbon—carbon double bonds present in the starting polymer.

The catalyst preferably has a Hammet Scale Value acidity ($H_o$) of less than −7, more preferably from −8.0 to −11.5, in order to be sufficiently active, particularly to form neo structures. Useful catalysts include $H_2SO_4$, $BF_3$, and HF. The trapping agent is preferably added in combination with the catalyst as a catalyst complex. Suitable catalyst complexes include the complexes of $BF_3$ with $HYR^3$ wherein Y is O and $R^3$ has formula (IV), such as $BF_3$ complexes with 2,4-dichlorophenol and 2-chloro-4-methylphenol.

The Koch process useful for preparing the functionalized hydrocarbon polymer employed in the present invention is further described in CA-A-2110871. Especially suitable for preparing the functionalized hydrocarbon polymer employed in the present invention are the batch Koch carbonylation process described in WO-A-95/35324 and the continuous carbonylation process described in WO-A-95/35325.

In the Koch process, a neo functional group (i.e., an acyl functional group attached to a tertiary carbon atom of the polymer) will generally result from an ethylenic double bond in which one of the carbon atoms of the double bond is fully substituted with hydrocarbyl groups. An iso functional group (i.e., the acyl functional group is attached to a secondary carbon atom of the polymer) will generally result from an ethylenic bond in which each carbon in the double bond has one hydrogen substituent. Thus, terminal vinylidene groups (defined below) in the polymer chain result in neo functional groups, and terminal vinyl will result in iso functional groups. As noted earlier, the functionalized hydrocarbon polymer reactant used in the present invention has at least about 50 mole % neo functional groups.

Referring to formula (III), the functional group is represented by the parenthetical expression —($CR^1R^2$—CO—$YR^3$), which expression contains the acyl group —CO—$YR^3$. It will be understood that the —$CR^1R^2$ moiety is not added to the polymer by the Koch reaction. Strictly speaking, it is the acyl group alone which constitutes the functional group, since it is the group added via the Koch reaction. Moreover, $R^1$ and $R^2$ represent groups originally present on, or constituting part of, the two carbons bridging the double bond before functionalization. However, $R^1$ and $R^2$ were included within the parenthetical so that neo acyl groups could be differentiated from iso acyl groups in the formula depending on the identity of $R^1$ and $R^2$.

Not all of the starting hydrocarbon polymer is necessarily functionalized in the Koch process. The weight fraction of functionalized hydrocarbon polymer based on the total weight of both functionalized and unfunctionalized polymer may be any value greater than zero, up to and including 1, and is typically at least about 0.50, preferably from about 0.65 to 0.99, and more preferably from about 0.75 to 0.99. The unfunctionalized hydrocarbon polymer is generally not removed from the composition before or after the amidation of the functionalized polymer, because it is generally difficult and/or uneconomical in practice to effect such a separation.

The polymers which are useful for functionalization by the Koch process are hydrocarbon polymers containing at least one carbon—carbon double bond (olefinic or ethylenic) unsaturation, wherein the maximum number of functional groups per polymer chain is limited by the number of double bonds per chain. Useful polymers in the present invention include polyalkenes including homopolymers, copolymers (used interchangeably with interpolymers) and mixtures thereof. Homopolymers and copolymers include those derived from polymerizable olefin monomers of 2 to about 28 carbon atoms; more typically 2 to about 6 carbon atoms.

Suitable polymers include the α-olefin polymers made using organo metallic coordination compounds. A preferred class of polymers are ethylene α-olefin copolymers such as those disclosed in U.S. Pat. No. 5,017,299. The polymer unsaturation can be terminal, internal or both. Preferred polymers have terminal unsaturation, preferably a high degree of terminal unsaturation. Terminal unsaturation is the unsaturation provided by the last monomer unit located in the polymer. The unsaturation can be located anywhere in this terminal monomer unit. Terminal olefinic groups include vinylidene unsaturation (also referred to in the art as ethenylidene unsaturation), $R^aR^bC{=}CH_2$; trisubstituted olefin unsaturation, $R^aR^bC{=}CR^cH$; vinyl unsaturation, $R^aHC{=}CH_2$; 1,2-disubstituted terminal unsaturation, $R^aHC{=}CHR^b$; and tetra-substituted terminal unsaturation, $R^aR^bC{=}CR^cR^d$. At least one of $R^a$ and $R^b$ is a polymeric hydrocarbyl group of the present invention, and the remaining $R^b$, $R^c$ and $R^d$ are hydrocarbyl groups as defined with respect to $R^1$, $R^2$, and $R^3$ above.

Low molecular weight polymers, also referred to herein as dispersant range molecular weight polymers, are polymers having $\overline{M}_n$ of from about 500 to 20,000 (e.g., about 700 to 20,000 and about 1,000 to 20,000), preferably about 700 to 15,000 (e.g., about 1,000 to 15,000), more preferably about 1,000 to 10,000 (e.g., about 1,500 to 10,000 and about 2,000 to 8,000), and most preferably from about 700 to 5,000 (e.g., about 1,000 to 4,000). The number average molecular weights can be determined by vapor phase osmometry or by gel permeation chromatography ("GPC"). Low molecular weight polymers are useful in forming dispersants for lubricant additives.

Medium molecular weight polymers have $\overline{M}_n$'s ranging from about 20,000 to 200,000, preferably from about 25,000 to 100,000, and more preferably from about 25,000 to 80,000, and are useful, for example, as viscosity index improvers in lubricating oil compositions. The medium $\overline{M}_n$ can be determined by membrane osmometry.

The values of the ratio $\overline{M}_w/\overline{M}_n$, referred to as molecular weight distribution ("MWD"), are not critical. However, a minimum $\overline{M}_w/\overline{M}_n$ value of about 1.1 to 2.0 is preferred, and a typical range is about 1.1 to 4.

The olefin monomers are preferably polymerizable terminal olefins; that is, olefins characterized by the presence in their structure of the group —$CR{=}CH_2$, where R is H or a hydrocarbon group. However, polymerizable internal olefin monomers can also be used to form the polyalkenes. When internal olefin monomers are employed, they normally will be employed with terminal olefins to produce polyalkenes which are interpolymers. A particular polymerized olefin monomer which can be classified as both a terminal olefin and an internal olefin is deemed herein to be a terminal olefin. Thus, pentadiene-1,3 (i.e., piperylene) is a terminal olefin.

As the term is used herein, "hydrocarbon polymer" includes polymers (e.g., polyalkenes) which contain non-hydrocarbon substituents, such as lower alkoxy (lower=1 to 7 carbon atoms); lower alkyl mercapto, hydroxy, mercapto, and carbonyl, wherein the non-hydrocarbon moieties do not substantially interfere with the functionalization of the polymer and the subsequent derivatization reactions of this invention. Such substituents typically contribute not more than about 10 wt.% of the total weight of the hydrocarbon polymer (e.g., polyalkene).

The polyalkenes can include aromatic groups and cycloaliphatic groups such as would be obtained from polymerizable cyclic olefins or cycloaliphatic substituted-polymerizable acrylic olefins, but polyalkenes free from aromatic and cycloaliphatic groups are generally preferred. Polyalkenes derived from homopolymers and interpolymers of terminal hydrocarbon olefins of 2 to about 28 carbon atoms are also preferred. This preference is qualified by the proviso that, while interpolymers of terminal olefins are usually preferred, interpolymers optionally containing up to about 40% of polymer units derived from internal olefins of up to about 28 carbon atoms are also within a preferred group. A more preferred class of polyalkenes are those selected from the group consisting of homopolymers and interpolymers of terminal olefins of 2 to 6 carbon atoms, more preferably 2 to 4 carbon atoms. Another preferred class of polyalkenes are the latter, more preferred polyalkenes optionally containing up to about 25% of polymer units derived from internal olefins of up to about 6 carbon atoms.

Specific examples of terminal and internal olefin monomers which can be used to prepare the polyalkenes according to conventional, well-known polymerization techniques include ethylene, propylene, butene-1, butene-2, isobutene, pentene-1, and the like; propylene-tetramer, diisobutylene, isobutylene trimer, butadiene-1,2, butadiene-1,3, pentadiene-1,2, pentadiene-1,3, and the like. Specific examples of polyalkenes include polypropylenes, isobutene homopolymers (i.e., polyisobutylenes), copolymers of isobutene with butene-1 and/or butene-2 (i.e., polybutenes), ethylene-propylene copolymers, ethylene-butene copolymers, propylene-butene copolymers, styrene-isobutene copolymers, isobutene-butadiene-1,3 copolymers, and the like, and terpolymers of isobutene, styrene and piperylene, and copolymer of 80 mole % of ethylene and 20 mole % of propylene. A useful source of polyalkenes are the polybutenes obtained by polymerization of $C_4$ refinery streams having a butene content of about 35 to 75% by weight, and an isobutene content of about 30 to 60% by weight, in the presence of a Lewis acid catalyst such as aluminum trichloride or boron trifluoride.

Also useful are the high molecular weight poly-n-butenes described in WO-A-94/13714. A preferred source of monomer for making poly-n-butenes is petroleum feed streams such as Raffinate II. These feedstocks are disclosed in the art such as in U.S. Pat. No. 4,952,739.

Preferred polymers are ethylene α-olefin copolymers; i.e., polymers of ethylene and at least one α-olefin of formula $H_2C{=}CHR^e$ wherein $R^e$ is straight chain or branched chain alkyl radical comprising 1 to 18 carbon atoms, and especially preferred are the foregoing ethylene α-olefin copolymers wherein the polymer contains a high degree of terminal vinylidene unsaturation. Preferably $R^e$ in the above formula is an alkyl of from 1 to 8 carbon atoms and more preferably is an alkyl of from 1 to 2 carbon atoms. Therefore, useful comonomers with ethylene in this invention include propylene, butene-1, hexene-1, octene-1, and so forth, and mixtures thereof (e.g. mixtures of propylene and butene-1, and the like). Preferred polymers are copolymers of ethylene and propylene; of ethylene and butene-1; and of ethylene, propylene, and butene-1.

The polymers can optionally contain units derived from a non-conjugated diene such as dicyclopentadiene, 1,4-hexadiene, and ethylidene norbornene, as well as other such dienes as are well known in the art.

The molar ethylene content of the polymers employed is preferably in the range of between about 20 and 80%, and more preferably between about 30 and 70%. When butene-1 is employed as comonomer with ethylene, the ethylene content of such copolymer is most preferably between about 20 and 45 wt %, although higher or lower ethylene contents may be present. The most preferred ethylene-butene-1 copolymers are disclosed in U.S. Ser. No. 992,192, filed Dec. 17, 1992, and incorporated herein by reference in its entirety. The preferred method for making low molecular weight ethylene α-olefin copolymer is described in U.S. Ser. No. 992,690, filed Dec. 17, 1992, herein incorporated by reference in its entirety.

Preferred ranges of number average molecular weights of ethylene α-olefin polymer for use as precursors for dispersants are from about 500 to 10,000; preferably from about 1,000 to 8,000 (e.g. from about 1,500 to 5,000); most preferably from about 2,500 to 6,000. A convenient method for such determination is GPC which additionally provides molecular weight distribution information. Such polymers generally possess an intrinsic viscosity (as measured in tetratin at 135° C.) of between 0.025 and 0.6 dl/g, preferably between 0.05 and 0.5 dl/g, most preferably between 0.075 and 0.4 dl/g.

The preferred ethylene α-olefin polymers are further characterized in that up to about 95% and more of the polymer chains possess terminal vinylidene-type unsaturation. Thus, one end of such polymers will be of the formula $POLY{-}C(R^f){=}CH_2$ wherein $R^f$ is $C_1$ to $C_{18}$ alkyl, preferably $C_1$ to $C_8$ alkyl, and more preferably methyl or ethyl and wherein POLY represents the polymer chain. A minor amount of the polymer chains can contain terminal ethenyl unsaturation, i.e. $POLY{-}CH{=}CH_2$, and a portion of the polymers can contain internal monounsaturation, e.g. $POLY{-}CH{=}CH(R^f)$, wherein $R^f$ is as defined above.

The preferred ethylene α-olefin polymer comprises polymer chains, at least about 30% of which possess terminal vinylidene unsaturation. Preferably at least about 50%, more preferably at least about 60%, and most preferably at least about 75% (e.g. 75 to 98%), of such polymer chains exhibit terminal vinylidene unsaturation. The percentage of polymer chains exhibiting terminal vinylidene unsaturation may be determined by FTIR spectroscopic analysis, titration, proton NMR, or C-13 NMR.

Another preferred class of polymers are α-olefin polymers; i.e., α-olefin homopolymers of an α-olefin of formula $H_2C{=}CHR^e$ and α-olefin copolymers of at least two alpha-olefins of formula $H_2C{=}CHR^e$ wherein $R^e$ is as defined above. The preferred alpha-olefin monomers are butene-1 and propylene and preferred alpha-olefin polymers are polypropylene, polybutene-1 and butene-1-propylene copolymer (e.g., butene-1-propylene copolymers having 5 to 40 mole % propylene). Preferred alpha-olefin polymers comprise polymer chains possessing high terminal unsaturation; i.e., at least about 30%, preferably at least about 50%, more preferably at least about 60%, and most preferably at least about 75% (e.g., 75 to 98%) of the chains have terminal vinylidene unsaturation.

The polymers can be prepared by polymerizing monomer mixtures comprising the corresponding monomers (e.g., ethylene with other monomers such as alpha-olefins, preferably from 3 to 4 carbon atoms) in the presence of a metallocene catalyst system comprising at least one metallocene (e.g., a cyclopentadienyl-transition metal compound) and an activator, e.g. alumoxane compound. The comonomer content can be controlled through selection of the metallocene catalyst component and by controlling the relative amounts of the monomers. Illustrative of the processes which may be employed to make the polymers are those described in U.S. Pat. No. 4,668,834, U.S. Pat. No. 4,704,491, EP-A-128046, EP-A-129368, and WO-A-87/03887.

The polymer for use in the present invention can include block and tapered copolymers derived from monomers comprising at least one conjugated diene with at least monovinyl aromatic monomer, preferably styrene. Such polymers should not be completely hydrogenated so that the polymeric composition contains olefinic double bonds, preferably at least one bond per molecule. The present invention can also include star polymers as disclosed in patents such as U.S. Patent Nos. U.S. Pat. Nos. 5,070,131; 4,108,945; 3,711,406; and 5,049,294.

Amidoamine Derivatives of Functionalized Polymer

The process of the invention comprises the steps of (A) reacting the functionalized hydrocarbon polymer with a volatile amine to amidate at least some of the —CO—Y—$R^3$ functional groups and form a first amidoamine adduct containing at least one reactive amino group, then (B) reacting the first amidoamine adduct with an α,β-unsaturated compound of formula (I) to form a second amidoamine adduct. In the reaction between the first amidoamine adduct and the α,β-unsaturated compound, the reactive amino groups in the adducts can react non-selectively with both the carbon—carbon double bonds and the —C(=X)Z functional groups in the unsaturated compounds. Alternatively, with suitable control of the reaction conditions as described below, the first amidoamine adduct can react selectively with the carbon—carbon double bonds only. In the case of selective reaction, the second amidoamine adduct is characterized by having unreacted —C(=X)Z functional groups. In a preferred embodiment of the process, this adduct is further reacted with a second amine in order to amidate the —C(=X)Z functional groups.

Reaction Step (A).

The volatile amine employed in reaction step (A) can be any amine having at least two reactive amino groups (or a mixture of such amines), which amine is sufficiently volatile relative to the amidoamine adduct to be selectively removed from the product mixture resulting from step (A) by such methods as stripping with an inert gas (e.g., nitrogen) with or without a partial vacuum and/or by distillation with or without a partial vacuum. As used herein, a reactive amino group can be a primary amino group (—$NH_2$) or a secondary amino group (—NH—). The volatile amine preferably contains at least one primary amino group and more preferably at least two primary amino groups.

The volatile amine is typically an amine containing from 2 to about 6 nitrogen atoms and from 2 to about 10 carbon atoms per molecule, or is a mixture of such amines. The amine may contain functional groups other than amino groups (e.g., hydroxy), but is preferably an aliphatic or alicyclic hydrocarbyl amine.

Suitable volatile amines include 1,3-diaminopropane (alternatively referred to as propylenediamine), 1,2-diaminopropane, 1,4-diaminobutane, hexamethylene diamine, decamethylenediamine, and 1,4-diaminocyclohexane. Suitable volatile amines also include the $N_2$ to $N_6$ ethylene polyamines, such as ethylene diamine, diethylene triamine, triethylene tetramine, tris-(2-aminoethyl)amine, bis-(2-aminoethyl)piperazine, tetraethylene pentamine, pentaethylene hexamine, piperazine and aminoethylpiperazine. Mixtures of the $N_2$ to $N_6$ ethylene polyamines can also be used. Ethylene polyamine mixtures are prepared commercially by the reaction of ethylene dichloride with ammonia. The resulting mixtures are often complex, containing linear, branched, and cyclic ethylene polyamines. Such mixtures, or distillation cuts of such mixtures, containing no or substantially no components higher than hexamines, may be employed as the volatile amine. For example, mixtures of linear, branched, and cyclic isomers of triethylene tetramine available commercially from Dow Chemical and Union Carbide are suitable for use as the volatile amine.

The reaction of the volatile amine with the functionalized hydrocarbon polymer is typically carried out at atmospheric or elevated pressure at a temperature in the range of from about 100° to 240° C., preferably from about 140° to 220° C., and more preferably from about 180° to 220° C. (e.g., 190° to 210° C.). The reaction time will vary depending upon the reaction temperature employed, the content of functional groups in the functionalized polymers, theamount of volatile amine employed, the degree of conversion desired and so forth, but typically is in the range of from about 0.5 to 24 hours and more typically from about 2 to 12 hours (e.g., 2 to 10 hours).

While the volatile amine may be used in any amount sufficient under the reaction time and conditions employed to provide at least some amidoamine adduct containing at least one reactive amino group, it is typically employed in an amount of volatile amine sufficient to convert at least about 50 mole % (e.g., 50 to 90 mole %), preferably at least about 80 mole % (e.g., 80 to 95 mole %), more preferably at least about 90 mole % (e.g., 90 to 98 mole %), and most preferably substantially all (i.e., 97 to 100 mole %) of the functionalized hydrocarbon polymer to the desired amidoamine adduct. The substantial conversion of the functionalized hydrocarbon polymer maximizes the incorporation of nitrogen into the amidoamine reaction product, which is advantageous, because it will lead to a higher nitrogen content in the final product. A high nitrogen content is typically desirable in dispersant and detergent applications.

The substantial to complete conversion of the polymer also minimizes or eliminates the presence of unconverted —CO—$YR^3$ functional groups in the reaction product which may be undesirable in certain circumstances. For example, the presence in the product of —CO—$YR^3$ groups in which $R^3$ is a halogen-containing group of Formula (IV) such as halophenyl (e.g., 2- or 4-chlorophenol), dihalophenyl (2,4-dichlorophenyl), and haloalkyl-phenyl (2-chloro-4-methylphenyl) or in which $R^3$ is a polyhaloalkyl group as heretofore described can ultimately lead to residual halogen (chlorine) in the final product. The presence of such residual halogen can make the product undesirable in additive applications because of environmental concerns.

Accordingly, the volatile amine is typically employed in an amount of at least 1 mole per equivalent of functional groups in the functionalized hydrocarbon polymer, and is preferably employed in an excess amount; i.e., the amount of volatile amine employed in the reaction is preferably more than one mole (e.g., 1.1 to 10 moles) and more preferably at least about two moles (e.g., 2 to 5 moles) per equivalent of functional groups in the functionalized hydrocarbon polymer.

The degree of conversion of the —CO—Y—$R^3$ acyl groups to amide groups can be monitored during the reaction by tracking the disappearance of the acyl group absorption band in the carbonyl region of the infrared spectrum and/or by the appearance of the amide band.

Solvents (which term as used herein also refers to diluents) which are inert to the reactants and to the resulting amidoamine adduct may be employed to promote heat and mass transfer during the reaction and to facilitate treating and handling of the post-reaction mixture. Suitable solvents include light hydrocarbons such as the $C_5$ to $C_{10}$ alkanes (e.g., pentanes, hexanes, and the like) and aromatic hydrocarbons such as toluene, xylenes, and the like. The use of such solvents is not preferred, however, in order to avoid solvent removal in a post-reaction step. Mineral lubricating oils or other inert lubricating base oils can also be employed as solvents and have the advantage of typically not requiring separation or removal from the amidoamine adduct product (which separation can be difficult to achieve in practice due to its relative non-volatility), when the adduct is subsequently used as an intermediate to prepare a final product to be employed as a lubricating oil additive in the same or a compatible base oil.

Unreacted volatile amine, $HYR^3$ compound formed during the amidation of the functionalized hydrocarbon polymer, plus any other volatile reaction byproducts or other components (e.g., volatile solvent) are typically removed from the reaction product mixture in order to minimize their interference with reaction step (B), such as by the reaction of the volatile amine and/or $HYR^3$ with the α,β-unsaturated compound. The removal can be effected by distillation or by inert gas stripping with or without a partial vacuum. If the $HYR^3$ compound has a substantially higher volatility than the volatile amine and the solvent (if employed) under the selected reaction conditions, it can, as an alternative, be selectively removed (e.g., by distillation or stripping) during the amidation reaction. In summary, the reaction mixture of reaction step (B) comprising the amidoamine adduct and the α,β-unsaturated compound is preferably substantially free of unreacted volatile amine and $HYR^3$ leaving group compound; e.g., the mixture contains less than about 1 wt. % and more preferably less than about 0.1 wt. % of each of unreacted volatile amine and $HYR^3$.

Reaction Step (B). The amidoamine adduct resulting from reaction step (A) is then reacted with an α,β-unsaturated compound of formula:

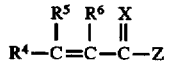

(I)

wherein X is sulfur or oxygen; Z is $—OR^7$, $—SR^7$, or $—NR^7(R^8)$; and $R^4$, $R^5$, $R^6$, $R^7$ and $R^8$ are the same or different and are hydrogen, hydrocarbyl, substituted hydrocarbyl, or heterocyclic.

When $R^4$, $R^5$, $R^6$, $R^7$ and $R^8$ are hydrocarbyl, these groups can comprise alkyl, cycloalkyl, or aryl. The substituted hydrocarbyl groups can be substituted with groups which are substantially inert to any component of the reaction mixture under conditions selected for reaction step (B). Such substituent groups include hydroxy, halide (e.g., Cl, Fl, I, Br), —SH and alkylthio. When one or more of $R^4$ through $R^8$ are alkyl, such alkyl groups can be straight or branched chain, and will generally contain from 1 to 20, more typically from 1 to 10, and especially from 1 to 4, carbon atoms. Illustrative of such alkyl groups are methyl, ethyl, propyl, butyl, pentyl, hexyl, heptyl, octyl, nonyl, decyl, dodecyl, tridecyl, hexadecyl, octadecyl and the like.

When one or more of $R^4$ through $R^8$ are aryl, the aryl group can be unsubstituted aromatic which will generally contain from 6 to 10 carbon atoms (e.g., phenyl, naphthyl). The aryl group can also be an alkyl substituted aromatic which will generally contain from about 7 to 20 carbon atoms, and more typically from 7 to 12 carbon atoms. Illustrative of such groups are tolyl, m-ethylphenyl, o-ethyltolyl, and m-hexyltolyl. The aryl group can also be aromatic-substituted alkyl, wherein the aromatic will generally consist of phenyl or $C_1$ to $C_6$ alkyl-substituted phenyl and the alkyl component generally contains from 1 to 12 carbon atoms, and preferably from 1 to 6 carbon atoms. Examples of such groups are benzyl, o-ethylbenzyl, and 4-isobutylbenzyl.

When one or more of $R^4$ to $R^8$ are cycloalkyl, the cycloalkyl group will generally contain from 3 to 12 carbon atoms, and more typically from 3 to 6 carbon atoms. Illustrative of such cycloalkyl groups are cyclopropyl, cyclobutyl, cyclohexyl, cyclooctyl, and cyclododecyl. When one or more of $R^4$ through $R^8$ are heterocyclic, the heterocyclic group generally consists of a compound having at least one ring of 6 to 12 members in which one or more ring carbon atoms is replaced by oxygen or nitrogen. Examples of such heterocyclic groups are furyl, pyranyl, pyridyl, piperidyl, dioxanyl, tetrahydrofuryl, pyrazinyl and 1,4-oxazinyl.

The α,β-ethylenically unsaturated carboxylate compounds employed herein have the following formula:

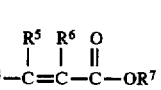

(V)

wherein $R^4$, $R^5$, $R^6$, and $R^7$ are the same or different and are as defined above. Examples of such α,β-ethylenically unsaturated carboxylate compounds of formula (V) are acrylic acid, methacrylic acid, the methyl, ethyl, isopropyl, n-butyl, and isobutyl esters of acrylic and methacrylic acids, 2-butenoic acid, 2-hexenoic acid, 2-decenoic acid, 3-methyl-2-heptenoic acid, 3-methyl-2-butenoic acid, 3-phenyl-2-propenoic acid, 3-cyclohexyl-2-butenoic acid, 2-methyl-2-butenoic acid, 2-propyl-2-propenoic acid, 2-isopropyl-2-hexenoic acid, 2,3-dimethyl-2-butenoic acid, 3-cyclohexyl-2-methyl-2 -pentenoic acid, 2-propenoic acid, methyl 2-propenoate, methyl 2-methyl 2-propchoate, methyl 2-butenoate, ethyl 2-hexenoate, isopropyl 2-decenoate, phenyl 2-pentenoate, tertiary butyl 2-propenoate, octadecyl 2-propenoate, dodecyl 2-decenoate, cyclopropyl 2,3-dimethyl-2-butenoate, methyl 3-phenyl-2-propenoate, and the like.

The α,β-ethylenically unsaturated carboxylate thioester compounds employed herein have the following formula:

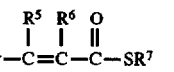

(VI)

wherein $R^4$, $R^5$, $R^6$, and $R^7$ are the same or different and are as defined above. Examples of such α,β-ethylenically unsaturated carboxylate thioesters of formula (VI) are methylmercapto 2-butenoate, ethylmercapto 2-hexenoate, isopropylmercapto 2-decenoate, phenylmercapto 2-pentenoate, tertiary butylmercapto 2-propenoate, octadecylmercapto 2-propenoate, dodecylmercapto 2-decenoate, cyclopropylmercapto 2,3-dimethyl-2-butenoate, methylmercapto 3-phenyl-2-propenoate, methylmercapto 2-propenoate, methylmercapto 2-methyl-2 propenoate, and the like.

The α,β-ethylenically unsaturated carboxyamide compounds employed herein have the following formula:

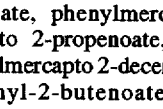

(VII)

wherein $R^4$, $R^5$, $R^6$, $R^7$ and $R^8$ are the same or different and are as defined above. Examples of α,β-ethylenically unsaturated carboxyamides of formula (VII) are 2-butenamide, 2-hexenamide, 2-decenamide, 3-methyl-2-heptenamide, 3-methyl-2-butenamide, 3-phenyl-2-propenamide, 3-cyclohexyl-2-butenamide, 2-methyl-2-butenamide, 2-propyl-2-propenamide, 2-isopropyl-2-hexenamide, 2,3-dimethyl-2-butenamide, 3-cyclohexyl-2-methyl-2-pentenamide, N-methyl 2-butenamide, N,N-diethyl-2-hexenamide, N-isopropyl 2-decenamide, N-phenyl 2-pentenamide, N-tertiary butyl 2-propenamide, N-octadecyl 2-propenamide, N-N-didodecyl 2-decenamide, N-cyclopropyl 2,3-dimethyl-2-butenamide, N-methyl 3-phenyl-2-propenamide, 2-propenamide, 2-methyl-2-propenamide, 2-ethyl-2-propenamide and the like.

The α,β-ethylenically thiocarboxylate compounds employed herein have the following formula:

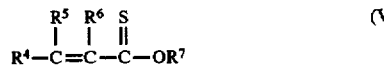

(VIII)

wherein $R^4$, $R^5$, $R^6$ and $R^7$ are the same or different and are as defined above. Examples of α,β-ethylenically unsaturated thiocarboxylate compounds of formula (VIII) are 2-butenthioic acid, 2-hexenthioic acid, 2-decenthioic acid, 3-methyl-2-heptenthioic acid, 3-methyl-2-butenthioic acid, 3-phenyl-2-propenthioic acid, 3-cyclohexyl-2-butenthioic acid, 2-methyl-2-butenthioic acid, 2-propyl-2-propenthioic acid, 2-isopropyl-2-hexenthioic acid, 2,3-dimethyl-2-butenthioic acid, 3-cyclohexyl-2-methyl-2-pententhioic acid, 2-propenthioic acid, methyl 2-propenthioate, methyl 2-methyl 2-propenthioate, methyl 2-butenthioate, ethyl 2-hexenthioate, isopropyl 2-decenthioate, phenyl 2-pententhioate, tertiary butyl 2-propenthioate, octadecyl 2-propenthioate, dodecyl 2-decenthioate, cyclopropyl 2,3-dimethyl-2-butenthioate, methyl 3-phenyl-2-propenthioate, and the like.

The α,β-ethylenically unsaturated dithioic acid and acid ester compounds employed herein have the following formula:

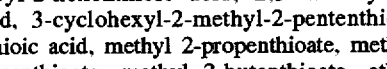

(IX)

wherein $R^4$, $R^5$, $R^6$ and $R^7$ are the same or different and are as defined above. Examples of α,β-ethylenically unsaturated dithioic acids and acid esters of formula (IX) are 2-butendithioic acid, 2-hexendithioic acid, 2-decendithioic acid, 3-methyl-2-heptendithioic acid, 3-methyl-2-butendithioic acid, 3-phenyl-2-propendithioic acid, 3-cyclohexyl-2-butendithioic acid, 2-methyl-2-butendithioic acid, 2-propyl-2-propendithioic acid, 2-isopropyl-2-hexendithioic acid, 2,3-dimethyl-2-butendithioic acid, 3-cyclo-hexyl-2-methyl-2-pentendithioic acid, 2-propendithioic acid, methyl 2-propendithioate, methyl 2-methyl 2-proendithioate, methyl 2-butendithioate, ethyl 2-hexendithioate, isopropyl 2-decendithioate, phenyl 2-pentendithioate, tertiary butyl 2-propendithioate, oxtadecyl 2-propendithioate, dodecyl 2-decendithioate, cyclopropyl 2,3-dimethyl-2-butendithioate, methyl 3-phenyl-2-propendithioate and the like.

The α,β-ethylenically unsaturated thiocarboxyamide compounds employed herein have the following formula:

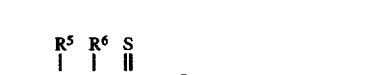

(X)

wherein $R^4$, $R^5$, $R^6$, $R^7$ and $R^8$ are the same or different and are as defined above. Examples of alpha, beta-ethylenically unsaturated thiocarboxyamides of formula (X) are 2-butenthioamide, 2-hexenthioamide, 2-decenthioamide, 3-methyl-2-heptenthioamide, 3-methyl-2- butenthioamide, 3-phenyl-2-propenthioamide, 3-cyclohexyl-2-butenthioamide, 2-methyl-2-butenthioamide, 2-propyl-2-propenthioamide, 2-isopropyl-2-hexenthioamide, 2,3-dimethyl-2-butenthioamide, 3-cyclohexyl-2-methyl-2-pententhioamide, N-methyl 2-butenthioamide, N,N-diethyl 2-hexenthioamide, N-isopropyl 2-decenthioamide, N-phenyl 2-pententhioamide, N-tertiarybutyl 2-propenthioamide, N-octadecyl 2-propenthioamide, N-N-didodecyl 2-decenthioamide, N-cyclopropyl 2,3-dimethyl-2-butenthioamide, N-methyl 3-phenyl-2-propenthioamide, 2-propenthioamide, 2-methyl-2-propenthioamide, 2-ethyl-2-propenthioamide and the like.

Preferred compounds for reaction with the amidoamine adduct formed in reaction step (A) are lower alkyl esters of acrylic and lower alkyl substituted acrylic acid. Illustrative of such preferred compounds are compounds of the formula:

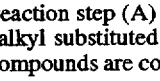

(XI)

where $R^9$ is hydrogen or a $C_1$ to $C_4$ alkyl group, such as methyl, and $R^{10}$ is hydrogen or a $C_1$ to $C_4$ alkyl group, capable of being removed so as to form an amido group, for example, methyl, ethyl, propyl, isopropyl, butyl, sec-butyl, tert-butyl, aryl, hexyl, etc. In one embodiment, these compounds are acrylic and methacrylic esters such as methyl, ethyl, propyl or butyl acrylate and methyl, ethyl, propyl, or butyl methacrylate.

The amidoamine adduct from reaction step (A) (i.e., the first amidoamine adduct) is reacted with the α,β-unsaturated compound under conditions effective to form a second amidoamine adduct. Depending upon the conditions employed, the reaction can involve either a non-selective reaction of the α,β-unsaturated compound (i.e., concurrent reaction of both the carbon—carbon double bonds and the —C(=X)Z groups) or the selective reaction of the carbon—carbon double bonds only. Non-selective reaction is carried out at atmospheric or elevated pressures and at a temperature at which both the double bonds and the functional groups undergo facile reaction with the reactive amino group(s) in the first amidoamine adduct. The temperature is typically in the range of from about 60° C. up to the lowest. decomposition temperature of any of the reactants or products, and is more typically in the range of from about 70° to 150° C. (e.g., 90° to 150° C). Lower temperatures can be employed, but will tend to decreaseamount of the less reactive —C(=X)Z functional groups which reacts with the first amidoamine adduct, thereby decreasing the non-selectivity of the reaction.

The reaction time involved can vary widely depending on a wide variety of factors such as reaction temperature, desired degree of conversion, and the like. For example, lower temperatures generally demand longer times. Usually, reaction times of from about 0.5 to 30 hours, such as 5 to 25 hours, and more typically times of about 2 to 12 hours will be employed. Although a solvent can be employed, the reaction can be run without the use of any solvent. It is preferred to avoid the use of an aqueous solvent such as water. However, taking into consideration the effect of solvent on the reaction, where desired, any suitable solvent can be employed, whether organic or inorganic, polar or non-polar. Suitable solvents include alkanols (e.g., $C_1$ to $C_6$ alkanols such as methanol, isopropanol, ethanol and the like), ethers, xylene, benzene, toluene, tretrahydrofuran, methylene chloride, chloroform, chlorobenzene, and the like.

If the amidoamine adduct to be employed as the reactant in reaction step (B) is in a mixture with an inert solvent earlier employed in reaction step (A) and not removed in a treatment step (e.g., a base oil such as mineral lubricating oil), the use of additional solvent here is usually not necessary.

The α,β-unsaturated reactant may be used in any amount sufficient under the reaction time and conditions employed to provide a product formed by the reaction of the α,β-unsaturated compound with reactive amino groups in the amidoamine adduct resulting from step (A) (the first amidoamine adduct). It is typically employed in an amount of α,β-unsaturated compound sufficient to convert at least a major portion (i.e., at least 50 mole %; e.g., 50 to 90 mole %), preferably at least about 80 mole % (e.g., 80 to 95 mole %), more preferably at least about 90 mole % (e.g., 90 to 98 mole %), and most preferably substantially all (i.e., at least 97 mole %) to all (99 to 100 mole %) of the first amidoamine adduct to the amidoamine adduct of step (B) (the second amidoamine adduct).

Those skilled in the art will recognize that the structure of the second amidoamine adduct resulting from the non-selective reaction of the α,β-unsaturated compound and the first amidoamine adduct from step (A) will depend in part upon the number of reactive amino groups available per adduct chain and on the relative amounts of the two reactants. For example, the α,β-unsaturated compound will tend to couple and/or extend amidoamine adduct chains having three or more reactive amino groups when the amidoamine is employed in an equimolar or excess molar amount, but will tend to crosslink the amidoamine chains when the α,β-unsaturated compound is itself employed in a molar excess, especially when the reaction is conducted for a time and under conditions that react substantially all of the reactive amino groups in the first amidoamine adduct. It is preferred, however, to avoid or at least minimize the crosslinking of the amidoamine chains. When reacted with amidoamine adducts having two reactive amino groups per chain, the use of about 0.25 to 0.50 mole of α,β-unsaturated compound per mole of amidoamine adduct will typically lead to the formation of varying amounts of both coupled amidoamine chains (i.e., AA—C—AA wherein AA represents an amidoamine adduct and C represents the α,β-unsaturated compound) and extended amidoamine chains (i.e., AA—C—AA—C—AA and the like). As the amount of α,β-unsaturated compound is reduced below 0.25 mole per mole of amidoamine, the formation of coupled amidoamines becomes more favored, while the use of α,β-unsaturated compound in amounts increasingly above 0.50 mole will favor the formation of chain extended products. When reacted with amidoamine adducts having one reactive amino group per chain, the use of α,β-unsaturated compound in amounts up to about 0.5 mole per mole of amidoamine adduct will favor formation of coupled amidoamine adduct chains. As the amount of α,β-unsaturated compound is increased above 0.5 mole, however, the formation of 1:1 adducts with the amidoamine becomes more favored. In any event, as those skilled in the art will recognize, for a given starting amidoamine adduct, product structure can be manipulated by suitable control of the reaction conditions in combination with the ratio of the equivalents of reactive amino groups to moles of α,β-unsaturated compound.

The progress of the reaction can be determined by measuring the disappearance of the carbon—carbon double bonds using carbon-13 NMR and by measuring the amount of the byproduct liberated as a result of the amidation of the —C(=X)Z groups (e.g., the amount of by product alcohol released by amidation of ester). Alternatively, the progress of the reaction can be determined by measuring the disappearance of reactive amino groups using nitrogen-15 NMR.

Reaction steps (A) and (B) are illustrated as follows, wherein the volatile amine is exemplified by linear diethylenetriamine ("DETA") and the α,β-unsaturated compound is exemplified by methyl acrylate (i.e., $R^4=R^5=R^6=H$; X=O; and $Z=OCH_3$ in formula (I)):

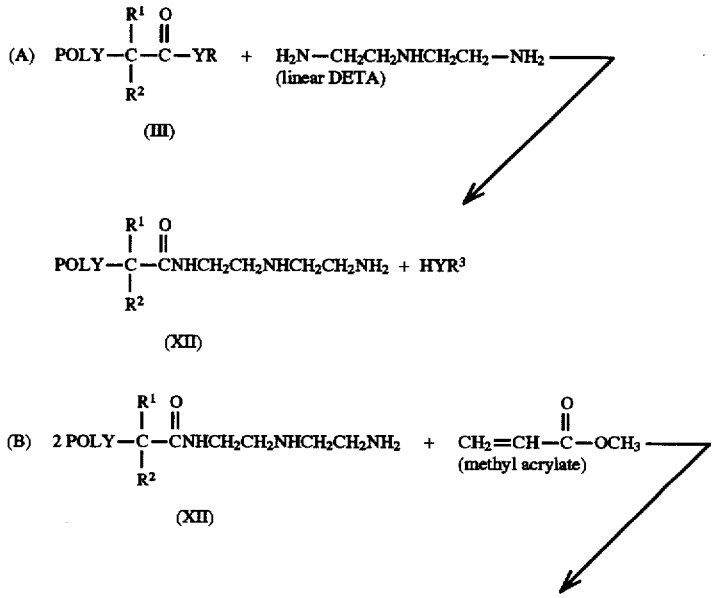

-continued

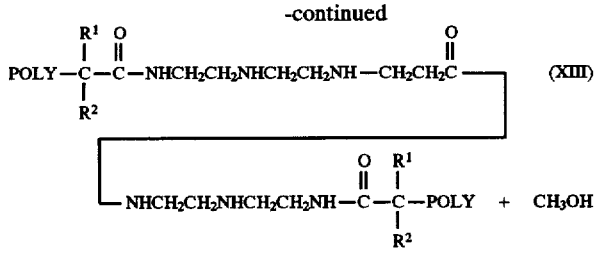

(XIII)

In the illustration, the first amidoamine adduct has the formula (XII) and has one reactive primary amino group and one reactive secondary amino group. The illustration shows the coupling of the first amidoamine adducts in reaction step (B) via the reaction of the carbon—carbon double bond in the methyl acrylate with the primary amino group in one amidoamine adduct (i.e., Michael addition) and the reaction of the —$COOCH_3$ group with the primary amino group of another amidoamine adduct (i.e., amidation), giving thereby a second amidoamine adduct of formula (XIII). In reaction step (B) of the illustration, 0.5 mole of methyl acrylate is employed per mole of (XII). The use of methyl acrylate in amounts increasingly greater than 0.5 mole will increasingly favor the formation of 1:1 adducts of (XII) and the acrylate via reaction of the amidoamine with either the acrylate's double bond or methyl ester group.

The secondary amino group in amidoamine adduct (XII) is also available for reaction with methylacrylate, but, because primary amino groups are normally more reactive than secondary amino groups, the formation of adduct (XIII) is generally favored. Nonetheless, adducts of the secondary amino group may form, especially where methyl acrylate is employed in an excess of the amount necessary to react all the primary amino groups and the selected reaction time and conditions are sufficient for reaction of the less reactive secondary amino groups.

Generally speaking, when both primary amino groups and secondary amino groups are available in the first amidoamine adduct for reaction in step (B), the reaction is typically run for a time and under conditions to avoid or at least minimize the reaction of the secondary amino groups.

The product mixture resulting from reaction step (B) containing the desired second amidoamine adduct is preferably treated (e.g., by distillation or by inert gas (e.g., $N_2$) stripping, optionally under vacuum) to substantially remove any volatile reaction byproducts and unreacted α,β-unsaturated compound. If employed, solvent can also be removed in the same or a separate treatment step.

In one embodiment of the process of the invention, reaction step (B) involves the selective reaction of the first amidoamine adduct with the α,β-unsaturated compound; i.e., the α,β-unsaturated compound is employed in step (B) under conditions effective to selectively react at least a portion of the carbon—carbon double bonds in the α,β-unsaturated compound with the reactive amino groups in the first amidoamine adduct, such that the second amidoamine adduct is characterized by having unreacted —C(=X)Z functional groups. Selective reaction can normally be achieved simply by decreasing the reaction temperature below the range suitable for the non-selective reaction of the double bonds and the —C(=X)Z groups of the α,β-unsaturated compound, thereby decreasing the reactivity of the less reactive functional groups. Accordingly, selective reaction is typically carried out at atmospheric or elevated pressure at a temperature from about −10° to 40° C. (e.g., from about 10° to 20° C). The extent of reaction can be determined by measuring the disappearance of the carbon—carbon double bonds using carbon-13 NMR or the disappearance of reactive amino groups using nitrogen-15 NMR. Lower temperatures can be used, although longer reaction times may be required. Higher temperatures can also be employed, provided that the reactivity of the less reactive —C(=X)Z functional groups remains negligible. The range and choices of other reaction conditions for selective reaction (e.g., reaction time, pressure, use of solvents, and the like) are the same or similar to those described above for non-selective reaction.

The α,β-unsaturated reactant may be used in any amount sufficient under the reaction time and conditions employed to provide a second amidoamine adduct formed by the selective reaction of the carbon—carbon double bonds in the α,β-unsaturated compound with reactive amino groups in the first amidoamine adduct resulting from step (A). The second amidoamine adduct is characterized by having unreacted —C(=X)Z groups in its structure, incorporated therein from the α,β-unsaturated compound. The α,β-unsaturated compound is typically employed in an amount sufficient to convert at least a major portion (i.e., at least 50 mole %; e.g., 50 to 90 mole %), preferably at least about 80 mole % (e.g., 80 to 95 mole %), more preferably at least about 90 mole % (e.g., 90 to 98 mole %), and most preferably substantially all (at least 98 mole %) to all (i.e., 99 to 100 mole %) of the amidoamine adduct of step (A) to the desired step (B) product. Accordingly, the α,β-unsaturated compound is typically employed in an amount of at least one mole per mole of first amidoamine adduct. An excess amount of α,β-unsaturated compound can also be employed, such as 1.1 to 10 moles, 1.25 to 5 moles, or 2 to 5 moles of unsaturated compound per mole of first amidoamine adduct.

The type of second amidoamine adduct formed via selective reaction in step (B) varies with theamount of α,β-unsaturated compound employed. Generally speaking, a more linear amidoamine tends to form when substantially equimolar amounts of the unsaturated compound and the first amidoamine adduct are reacted. A more branched amidoamine tends to form when an excess of the ethylenically unsaturated reactant of formula (I) is used. Of course, factors other than the relative amounts of the reactants can influence the degree of branching in the resulting second amidoamine adduct. For example, if the first amidoamine reactant contains more than one reactive amino group per molecule, there is a statistically greater probability of branching relative to a first amidoamine having only one amino reactant, because it has more N—H moieties available for reaction.

Selective reaction in step (B) is illustrated as follows for the above-described first amidoamine adduct of structure (XII):

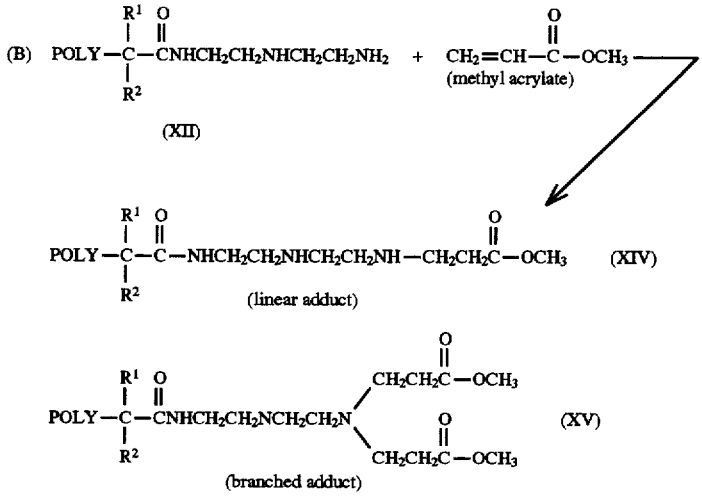

The illustration shows that the selective reaction of the first amidoamine adduct (XII) with the carbon—carbon double bond of methyl acrylate can result in amidoamine adducts of formula (XIV) and (XV), each containing one or more unreacted —$COOCH_3$ groups. Reaction (B) tends to form adduct (XIV) when equimolar amounts of the first adduct (XII) and methyl acrylate are employed. The use of excess methyl acrylate favors the formation of adduct (XV).

The secondary amino group in amidoamine adduct (XII) is also available for reaction with methyl acrylate, but, because primary amino groups are normally more reactive than secondary amino groups, the formation of adducts (XIV) and (XV) is normally favored. Nonetheless, at least some adducts of the secondary amino group may form. For example, if the methyl acrylate were used in an amount exceeding two moles per mole of (XII) and the selected reaction time and conditions were sufficient for reaction of the less reactive secondary amino groups, the following triply branched adduct can be formed:

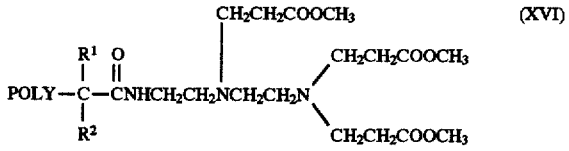

As is the case for non-selective reaction, when both reactive primary amino groups and reactive secondary amino groups are available in the first amidoamine adduct, the selective reaction is typically run for a time and under conditions to avoid or minimize the reaction of the secondary amino groups.

The second amidoamine adduct resulting from selective reaction in reaction step (B) can optionally be further reacted with a second amine. While the product of step (B) is itself useful as an additive in lubricating oils and in fuels, the further reaction of the step (B) product with an amine results in product having a higher nitrogen content, which can be desirable in certain additive applications (e.g., dispersants). The second amidoamine adduct resulting from selective reaction in step (B) has unreacted —C(=X)Z groups (e.g., ester groups or thioester groups) in its structure which are amidated with the second amine.

The second amine can be any amine containing at least one reactive amino group (i.e., a primary or a secondary amino group capable of reacting with the second amidoamine adduct to form amides), preferably containing at least one primary amino group, and more preferably containing at least two reactive amino groups at least one of which is a primary amino group, and mixtures of such amines. The second amine can optionally contain other reactive or polar groups, provided they do not interfere with the amidation reaction. The second amine can be a hydrocarbyl amine or a substituted hydrocarbyl amine containing substituent groups such as hydroxy, alkoxy, nitriles and the like. The second amine may be the same or different from the heretofore described volatile amine employed in reaction step (A). A suitable second amine is an alkylene polyamine of about 2 to 60 (e.g., 2 to 30), preferably 2 to 40 (e.g., 4 to 20), most preferably 2 to 20 total carbon atoms and about 2 to 12 (e.g., 2 to 9), preferably 3 to 12, and most preferably 3 to 9 nitrogen atoms per molecule, and mixtures thereof. Exemplary alkylene polyamines include tetraethylene pentamine ("TEPA"), pentaethylenehexamine ("PEHA"), di-(1,2-propylene)triamine, and di-(1,3-propylenetriamine). Among the useful alkylene polyamines are commercial mixtures of ethylene amines averaging 5 to 7 nitrogen atoms per molecule available under the tradename E-100 (Dow Chemical) and HPA-X (Union Carbide).

Another suitable second amine is a heavy alkylene polyamine which is defined herein as a mixture of higher oligomers of alkylene polyamines, having an average of at least about 7 nitrogen atoms per molecule. A preferred heavy polyamine is a mixture of ethylene polyamines containing essentially no TEPA, at most small amounts of pentaethylene hexamine, and the balance oligomers with more than 6 nitrogens and more branching than conventional commercial polyamine mixtures, such as the E-100 and HPA-X mixtures noted in the preceding paragraph.

A useful heavy alkylene polyamine composition is commercially available from Dow Chemical under the tradename HA-2. HA-2 is a mixture of higher boiling ethylene polyamine oligomers and is prepared by distilling out all the lower boiling ethylene polyamine oligomers (light ends) up to and including TEPA. The TEPA content is less than 1 wt. %. Only a small amount of PEHA, less than 25 wt. %, usually 5–15 wt. %, remains in the mixture. The balance is higher nitrogen content oligomers with a great degree of branching. The heavy polyamine preferably contains essentially no oxygen. Typical analysis of HA-2 gives primary nitrogen values of 7.8 milliequivalents (meq) (e.g., 7.7 to 7.8) of primary amine per gram of polyamine. This calculates to be about an equivalent weight (EW) of 128 grams per equivalent (g/eq). The total nitrogen content is about 32.0–33.0 wt. %. In comparison, conventional commercial polyamine mixtures such as E-100 and HPA-X typically have 8.7–8.9 meq of primary amine per gram and a nitrogen content of about 33 to 34 wt. %.

Another suitable second amine is a one-armed amine, which is defined herein as an amine containing an average of one primary amino group and one or more secondary or tertiary amino groups per molecule. The one-armed amine preferably contains one primary amino group and 1 to 10 secondary or tertiary amino groups. Mixtures of such one-armed amines are also suitable. Exemplary one-armed amines are dimethylamino-propylaminopropylamine and polypropylenetetramine with one end substituted with a tallow group and having approximately one primary amine per molecule. Suitable one-armed amines are further described in WO-A-95/35329.

The choice of second amine for reaction with the second amidoamine adduct depends in part upon the desired amount of nitrogen incorporation in the resulting product. For example, when a relatively high nitrogen content is necessary or desired, the second amine is selected from amines with a higher nitrogen content such as a high nitrogen containing alkylene polyamine (e.g., TEPA, PEHA, heavy alkylene polyamine, etc.).

The second amidoamine adduct resulting from selective reaction in step (B) is reacted with the second amine under conditions effective to amidate at least a portion of the —C(=X)Z functional groups in the second amidoamine adduct. The reaction may be carried out at any temperature up to the decomposition of the reactants and products, but is typically conducted at temperatures of from about 50° to 250° C. (e.g., 100° to 250° C.), and preferably from about 125° to 175° C. The reaction time can vary widely depending upon the choice and amount of second amine and amidoamine adduct to be reacted, the desired degree of conversion, reaction temperature, and the like. Reaction times are typically from about 1 to 15 hours (e.g., from 1 to 10 hours).

Where an acrylic-type ester is employed, the progress of the reaction can be judged by the removal of the alcohol in forming the amide. During the early part of the reaction, alcohol is removed quite readily below 100° C. in the case of low boiling alcohols such as methanol or ethanol. As the reaction slows, the temperature is raised to push the amidation to completion and the temperature may be raised to 150° C. toward the end of the reaction. Removal of alcohol is a convenient method of judging the progress and completion of the reaction which is generally continued until no more alcohol is evolved. Based on removal of alcohol, the yields are typically stoichiometric. In more difficult reactions, yields of at least 95 percent are typically obtained.

Similarly, the reaction of an ethylenically unsaturated carboxylate thioester of formula (VI) liberates the corresponding $HSR^7$ compound (e.g., $H_2S$ when $R^7$ is hydrogen) as a by-product, and the reaction of an ethylenically unsaturated carboxyamide of formula (VII) liberates the corresponding $HNR^7(R^8)$ compound (e.g., ammonia when $R^7$ and $R^8$ are each hydrogen) as by-product. The progress of these reactions can be judged by the liberation and/or removal of these by-products.

Although not required, any solvent—whether organic or inorganic, polar or nonpolar—that is inert to the reactants and products under the selected reaction conditions can be employed in reaction step (C). If the step (B) product employed in reaction step (C) is in a mixture with an inert solvent earlier employed in reaction step (B) and not removed in a treatment step (e.g., a base oil such as mineral lubricating oil), the use of additional solvent here is usually not necessary.

The second amine may be employed in anyamount under the selected reaction time and conditions sufficient to amidate at least a portion of the —C(=X)Z functional groups in the second amidoamine adduct. The second amine is typically employed in an amount sufficient to convert a major portion (i.e., at least 50 mole %), preferably at least 80 mole %, (e.g., 80 to 90 mole %), more preferably at least 90 mole % (e.g., 90 to 95 mole %), and most preferably substantially all (i.e., 95 to 100 mole %) of the —C(=X)Z functional groups in the second adduct. Accordingly, the second amine is typically employed in an amount of at least one equivalent of reactive amino groups per equivalent of —C(=X)Z functional groups. The second amine can be used in an excess amount (e.g., 1.1 to 5 or 1.2 to 4 equivalent of reactive amino groups per equivalent of —C(=X)Z functional groups) in order to achieve substantial conversion and to reduce reaction time. However, it is generally preferred to avoid the use of excess amounts of second amine that would lead under the reaction conditions employed to the significant presence of unreacted amine (i.e., more than about 5 wt. %) in the reaction mixture at the conclusion of the reaction, particularly where the unreacted second amine (e.g., a heavy polyamine) cannot be conveniently removed from the reaction mixture (e.g., by nitrogen stripping or vacuum distillation). When the second amine contains a primary amino group (or groups) or both a primary amino group (or groups) and a secondary amino group (or groups), the second amine is preferably used in an amount of at least one equivalent of primary amino groups per equivalent of —C(=X)Z functional groups, wherein, because the primary amino groups are normally more reactive than the secondary amino groups, the amidation reaction will occur substantially between the —C(=X)Z groups and the primary amino groups.

Those skilled in the art will recognize that the structure of the resulting products will depend in part upon the number of reactive amino groups per second amine molecule and the number of —C(=X)Z groups per second amidoamine adduct. For example, the use of a primary or secondary monoamine as the second amine will result in the simple addition of the monoamines to the second amidoamine adducts. A second amine containing two reactive amino groups (e.g., ethylene diamine) can, in addition to forming simple adduct product, act to couple together individual amidoamine adduct chains and to extend amidoamine adduct chains having at least two —C(=X)Z groups per chain, when such bi-and/or multifunctional chains are present. Second amines with three or more reactive amino groups can act as chain crosslinkers to crosslink bi- and multifunctional amidoamine adduct chains in addition to acting as chain couplers and/or chain extenders. Accordingly, the skilled artisan will further recognize that suitable manipulation of the reaction conditions in combination with the selection of the second amine and manipulation of the ratio of reactive amino groups to —C(=X)Z groups can control the degree of simple addition and, where the following are possible, the degree of chain coupling, chain extension, and/or chain crosslinking.

Reaction of a second amine with the second amidoamine adduct obtained by selective reaction in step (B) is illustrated by the reaction of TEPA with second amidoamine adduct (XIV) as follows, where LINK represents $-[CH_2CH_2NH]_3CH_2CH_2-$:

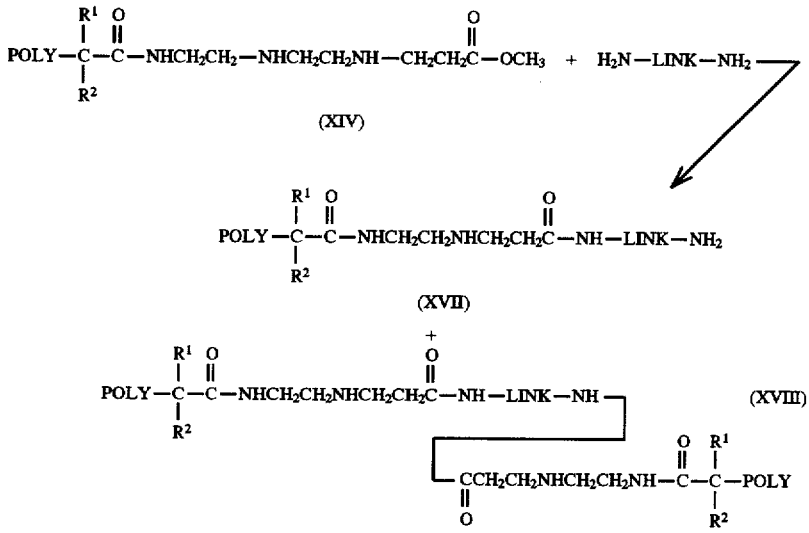

Product (XVII) results from the simple addition of TEPA to adduct (XIV), and product (XVIII) results from chain coupling. The relative proportion of products (XVII) and (XVIII) will depend upon such factors as the amount of TEPA reactant employed and the degree of conversion achieved. The use of a substantial excess of TEPA (e.g., at least 2 moles of TEPA per mole of —$COOCH_3$ ester groups) will typically favor the formation of product (XVIF), whereas the use of equimolar amounts of TEPA and —C(=X)Z groups will favor product (XVIII), particularly when the reaction is run for a time and under conditions sufficient to react substantially all of the —$COOCH_3$ ester groups. The use of an equimolaramount of TEPA in combination with a high conversion of the —C(=X)Z groups is preferred in order to avoid removing unreacted TEPA in a post-reaction step.

As an alternative to using a second amine, the second amidoamine adduct resulting from selective reaction in reaction step (B) can be further reacted with a first amidoamine adduct of step (A), which may be the same or different from the first amidoamine adduct used to obtain the second amidoamine adduct. The relative amount of reactants and the conditions suitable for this reaction are the same or similar to those described above for reacting of the second amine with the second amidoamine adduct.

The process of the invention also includes a process for preparing a product useful as an additive in fuels and lubricating oils comprising reaction step (A) as heretofore described and the step of reacting the first amidoamine adduct of step (A) with another amidoamine adduct formed by reacting (i) an α,β-unsaturated compound of formula (I) and (ii) a polyamine having at least two reactive amino groups selected from the group consisting of primary amino groups, secondary amino groups, and mixtures thereof, under conditions effective to selectively react at least a portion of the carbon—carbon double bonds in the α,β-unsaturated compound with the reactive amino groups in the polyamine, such that the other amidoamine adduct is characterized by having unreacted —C(=X)Z functional groups; wherein the first amidoamine adduct is reacted with the other amidoamine adduct under conditions effective to amidate at least a portion of the —C(=X)Z functional groups. The amount of α,β-unsaturated compound and the reaction conditions suitable for this selective reaction are the same or similar to those described above for the step (B) selective reaction of α,β-unsaturated compound and first amidoamine adduct. The polyamines preferably have at least two primary and amino groups, and preferably the reaction is conducted under conditions which avoid or minimize reaction with any secondary amino groups which may be available. The alkylene polyamines described above in the discussion of second amines are particularly suitable.

Post-treatment.

The product resulting (i) from non-selective reaction in step (B), (ii) from selective reaction in step (B) and optionally modified by further reaction, or (iii) from the process described in the preceding paragraph can be post-treated. The processes used for post-treating are analogous to the post-treating processes used for conventional dispersants and viscosity modifiers. Accordingly, the same reaction conditions, ratio of reactants and the like can be used. Thus, the amidoamine product can be post-treated with such reagents as urea, thiourea, carbon disulfide, aldehydes, inorganic acids, carboxylic acids, dicarboxylic acid anhydrides, hydrocarbyl substituted succinic anhydrides, nitriles, epoxides, boron compounds, phosphorus compounds and the like.

In one embodiment, the product can be borated by post-treating the product with a borating agent to obtain a borated product containing at least about 0.01 weight percent of boron based on the total weight of the borated product. The borated product can contain up to about 10 wt. % boron (e.g., 3 to 10 wt. %) but preferably has 0.05 to 2 wt. %, e.g., 0.05 to 0.7 wt. % boron. Suitable borating agents include boron halides, (e.g. boron trifluoride, boron tribromide, boron trichloride), boron acids, and simple esters of the boron acids (e.g., trialkyl borates coming 1 to 8 carbon alkyl groups such as methyl, ethyl, n-octyl, 2-ethylhexyl, etc.).

The boration reaction is typically carried out by adding from about 0.05 to 5 wt. %, e.g., 1 to 3 wt. % (based on the weight of the product) of the borating agent, and heating with stirring at from about 90° to 250° C., preferably 135° to 190° C. (e.g., 140° to 170° C.), for from about 1 to 10 hrs. followed by nitrogen stripping in said temperature ranges. The borating agent is preferably boric acid which is most usually added as a slurry to the reaction mixture.

A suitable low sediment process involves borating with a particulate boric acid having a particle size distribution characterized by a $\phi$ value of not greater than about 450. The process is described in U.S. Pat. No. 5,430,105.

In another embodiment, the product can be post-treated by reaction with a phosphorus-containing agent to introduce phosphorus or phosphorus-containing moieties into the product. Suitable phosphorus-containing agents include phosphorus acids, phosphorus oxides, phosphorus sulfides, phosphorus esters and the like. Suitable inorganic phosphorus compounds include phosphoric acid, phosphorous acid, phosphorus pentoxide, and phosphorus pentasulfide. Suitable organic phosphorus compounds include mono-, di- and trihydrocarbyl phosphates, the hydrocarbylpyrophosphates, and their partial or total sulfur analogs wherein the hydrocarbyl group(s) contain up to about 30 carbon atoms each. Illustrative post-treatments employing phosphorus compounds are described in U.S. Pat. No. 3,184,411, 3,342,735, 3,403,102, 3,502,677, 3,511,780, 3,513,093, 4,615,826, and 4,648,980, and in GB-A-1153161 and 2140811.

In still another embodiment, the product can be post-treated by reaction with a low molecular weight dicarboxylic acid acylating agent such as maleic anhydride, maleic acid, fumaric acid, succinic acid, alkenyl or alkyl substituted succinic acids or anhydrides (in which the alkyl or alkenyl substituent has from 1 to about 24 carbon atoms), and the like. The acylating agent is typically reacted with the amidoamine product at temperatures in the range of from about 80° to 180° C. for a time ranging from about 0.1 to 10 hours, optionally in the presence of an inert solvent.

In a further embodiment, the product can be post-treated by reaction with a strong inorganic acid, such as with a mineral acid selected from sulfuric, nitric and hydrochloric acid at a temperature of from about 93° to 204° C., as described in U.S. Pat. No. 4,889,646.

Compositions.

The products of the present invention include products comprising second amidoamine adducts obtained by the selective reaction of the first amidoamine adduct of step (A) with the $\alpha,\beta$-unsaturated compound of formula (I), which adducts have been optionally further reacted with a second amine, as described above. The products of the invention also include products obtained by reacting the first amidoamine adduct of the above-described reaction step (A) with another amidoamine adduct formed by the selective reaction of (i) an $\alpha,\beta$-unsaturated compound of formula (I) and (ii) a polyamine, as described above.

The products of the invention possess properties (e.g., good dispersancy and detergency) which make them useful as additives in fuels and in lubricating oils. The additives of the invention are used by incorporation into the lubricating oils and fuels. Incorporation may be done in any convenient way and typically involves dissolution or dispersion of the additives into the oil or fuel in a dispersant or detergent—effective amount. The blending into the fuel or oil can occur at room or elevated temperature. Alternatively, the additives can be blended with a suitable oil-soluble solvent/diluent (such as benzene, xylene, toluene, lubricating base oils and petroleum distillates, including the various normally liquid petroleum fuels noted below) to form a concentrate, and then the concentrate can be blended with a lubricating oil or fuel to obtain the final formulation. Such additive concentrates will typically contain on an active ingredient (AI) basis from about 10 to 80 weight percent, typically 20 to 60 wt. %, and preferably from about 40 to 50 wt. % additive, and typically from about 40 to 80 wt. %, preferably from about 40 to 60 wt. % base oil (or fuel) based on concentrate weight.

When the additives of this invention are used in normally liquid petroleum fuels such as middle distillates boiling from about 65° to 430° C., including kerosene, diesel fuels, home heating fuel oil, jet fuels, etc., a concentration of the additives in the fuel in the range of typically from about 0.001 to 0.5 wt. %, and preferably 0.005 to 0.15 wt. %, based on the total weight of the composition, will usually be employed.

Fuel compositions of this invention can contain other conventional additives in addition to the additive of the invention. These can include anti-knock agents, cetane improvers, metal deactivators, deposit modifiers/preventors, and anti-oxidants.

The additives of the present invention find their primary utility in lubricating oil compositions which employ a base oil in which the additives are dissolved or dispersed therein. Such base oils may be natural or synthetic. Base oils suitable for use in preparing the lubricating oil compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additives of the present invention in base oils conventionally employed in and/or adapted for use as power transmitting fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Natural oils include animal oils and vegetable oils, liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. Synthetic lubricating oils include hydrocarbon oils and halosubstituted hydrocarbon oils such as polymerized and interpolymerized olefins (e.g., polybutylenes, polypropylenes, propylene-isobutylene copolymers, and chlorinated polybutylenes). Other suitable synthetic oils include alkylene oxide polymers, interpolymers and derivatives thereof where the terminal hydroxyl groups have been modified by esterification, etherification, and the like; esters of dicarboxylic acids; esters made from $C_5$ to $C_{12}$ monocarboxylic acids and polyols and polyol ethers such as neopentyl glycol; and silicon-based oils such as the polyalkyl-polyaryl-, polyalkoxy-, or polyaryloxysiloxane oils and silicate oils.

The additives of the present invention may be mixed with other types of conventional additives, each selected to perform at least one desired function. Among the other additives which may be in the lubricating oil formulation are metal containing detergent/inhibitors, viscosity modifiers, and anti-wear agents. The metal detergent/inhibitors are generally basic or overbased alkali or alkaline earth metal salts or mixtures thereof (e.g. mixtures of Ca and Mg salts) of one or more organic acids (e.g., sulfonates, naphthenates, phenates and the like). Viscosity modifiers are generally hydrocarbon polymers or polyesters, optionally derivatized to impart dispersancy or some other property, having number average molecular weights of from $10^3$ to $10^6$. The anti-wear agents are typically oil-soluble zinc dihydrocarbyl dithiophosphates.

Other additives which may be employed in the formulation are antioxidants, corrosion inhibitors, pour depressants, friction modifiers, foam inhibitors, demulsifiers, flow improvers, and seal swell control agents. Conventional dispersants can also be employed in addition to the additives of the invention.

These other additives are typically blended into the base oil in amounts which are effective to provide their normal attendant function. Whether used alone or in combination with these other additives, the additives of the present invention are generally employed (e.g., as a dispersant additive) in an amount of about 0.01 to 20 wt. %, preferably 0.1 to 10 wt. %, most preferably 0.1 to 6 wt. %, based upon the total weight of the composition.

Additive concentrates comprising concentrated solutions of the additives of this invention together with one or more of these other additives can be prepared by adding the additives to the base oil, wherein the subject additives of this invention are added in concentrate amounts as described above. The collective amounts of the subject additive together with other additives is typically from about 2.5 to 90 wt. %, preferably 15 to 75 wt. %, and most preferably 25 to 60 wt. % additives with base oil as the balance. The concentrate will typically be formulated to contain the additives in the amounts necessary to provide the desired concentration in the final formulation when the concentrate is combined with a predetermined amount of base lubricant.

Unless otherwise indicated, all of the weight percents expressed herein are based on the active ingredient content of the additive, and/or upon the total weight of any additive package or formulation which will be the sum of the AI weight of each additive plus the weight of the total oil or diluent.

The active ingredient contents expressed herein reflect the AI content added to (i.e., incorporated into) the foregoing compositions and concentrates. This value can differ from the actual amount of additive present in the compositions and concentrates as a result of additive interactions and/or environmental exposures (e.g., to air) during blending, storage and/or use.

EXAMPLES

The following examples illustrate, but do not limit the scope of, the present invention. Values of $\overline{M}_n$, ethylene comonomer content, and/or olefin content reported below for ethylene-butene-1 copolymers were determined using carbond-13 NMR. Values of the ratio of aliphatic carbon to carbonyl carbon and the neo content of the carbonylated polymers were determined using carbon-13 NMR. Values for the conversion of polymer to carbonylated polymer were determined by separating the carbonylated (i.e., functionalized) and non-carbonylated (unfunctionalized) polymer components using column chromatography and then determining the weight fractions of the separated components. Values for the nitrogen content of various products were determined using a Carlo Erba analyzer.

Example 1

An ethylene-butene-1 copolymer (46 wt. % ethylene, Mn=3300, about 63% terminal vinylidene) prepared via Ziegler-Natta polymerization with zirconium metallocene catalyst and methyl alumoxane cocatalyst was carbonylated with carbon monoxide in the presence of $BF_3$ and 2,4-dichlorophenol in a continuous stirred tank reactor (reaction temperature=70° C., residence time of about twenty minutes, CO partial pressure=9,032 kPa (1310 psia), $BF_3$ partial pressure=3,448 kPa (500 psia), dichlorophenol to copolymer mole ratio=6:1, $BF_3$ to CO mole ratio =0.38:1) to form a 2,4-dichlorophenyl ester functionalized polymer. Conversion to carbonylated polymer (i.e., ester functionalized polymer) was 88.2 wt. %. The ester had a ratio of the number of aliphatic carbon atoms to the number of CO carbon atoms of 307. About 100% of the ester functional groups were neo substituted groups.

300 grams of the resulting polymer ester was aminated with propane diamine in a diamine to ester mole ratio or 5:1 by mixing the ester and diamine at room temperature and then allowing the mixture to increase in temperature to the refluxing temperature of the diamine (140°–145° C.). Infrared monitoring of the reaction mixture showed complete disappearance of the ester absorption bands and appearance of the amide band after one hour at 140° C. The excess diamine was distilled off and the residue was vacuum stripped at 180° C. for two hours to remove 2,4-dichlorophenol produced by the displacement. Carbon-13 NMR analysis showed 100 percent conversion to the desired amidoamine adduct. The product analyzed for 0.71 wt. % N.

Example 2

100 grams of the product of Example 1 were diluted in 50 ml of heptane and 3 grams of methyl acrylate were added. About 5 ml of methanol was added and the reaction mixture was stirred at room temperature overnight, after which the solvent was stripped off under vacuum at 80° C. to a constant weight in about three hours. Infrared analysis of the stripped adduct showed strong ester and amide adsorption bands which indicated that the methyl acrylate was incorporated by a Michael addition via the amine group of the starting amidoamine. The carbonyl region of the carbon—13 NMR spectrum shows an ester:amide ratio of 1.2:1. The stripped adduct analyzed for 0.62 wt.. % N.

Example 3

150 grams of the product of Example 1 were diluted with 50 ml of heptane and 10 ml methanol, followed by addition of 15 grams of methyl acrylate. The mixture was then stirred at room temperature overnight, after which the solvent and excess acrylate ester were stripped off under vacuum at 80° C. to a constant weight in about three hours. The infrared spectrum of the stripped adduct contained intense ester and amide adsorption bands. The stripped adduct analyzed for 0.59 wt. % N. Carbon-13 NMR showed a carbonyl region with an ester:amide ratio of 1.7:1.

Example 4

5 grams of the adduct of Example 2 were mixed with 5 grams of N,N-dimethyldiaminopropane, and the mixture was heated to and maintained under nitrogen at 150° C. for 4 hours. Infrared monitoring of the reaction mixture showed the complete disappearance of the ester band. Carbon-13 NMR analysis of the product showed two carbonyl peaks at 172 ppm and 177 ppm assigned to the acrylate-bound and the ethylene-butene-polymer-bound amides respectively. Carbon-13 analysis also showed that the ratio of acrylate amide to EB polymer amide was about 1.2:1, which corresponded to the ester:amide ratio of 1.2:1 of the starting adduct and thus indicated 100% yield. The product analyzed for 1.71 wt. % N.

Example 5

88 grams of the product of Example 2 and 2.3 grams of Polyamine HA-2 (Dow Chemical) were dissolved in 71 grams of mineral oil solvent 150 neutral. The reaction mixture was heated to and maintained at 150° C. for nine hours. Infrared monitoring of the reaction mixture showed that the ester had been completely converted to amide. The filtered product analyzed for 0.78 wt. % N.

Example 6

An ethylene-butene-1 copolymer (45 wt. % ethylene, $\overline{M}_n$=3000, about 63% terminal vinylidene) prepared via Ziegler-Natta polymerization with zirconium metallocene and methyl alumoxane, was carbonylated with carbon monoxide in the presence of $BF_3$ and 1,1,1,3,3,3-hexafluoroisopropanol in a continuous stirred tank reactor under conditions as described in Example 1 to form a hexafluoroisopropyl ester functionalized polymer. Conversion to carbonylated polymer was 82.2 wt. %. The ester had a ratio of the number of aliphatic carbon atoms to the number of CO carbon atoms of 184. About 100% of the ester functional groups were neo substituted.

400 grams of the resulting polymer ester were aminated with 1,3-propanediamine in a diamine to ester mole ratio of 10:1 by mixing the ester and diamine at room temperature and then allowing the mixture to increase in temperature to the refluxing temperature of the diamine. Complete conversion of the ester to amide was obtained after heating for nine hours at 140° C. The excess diamine and the displaced hexafluoroisopropanol were distilled off under vacuum at 180° C. Carbon-13 NMR showed the presence of about 98.1% amide and about 1.9% acid in the product. The acid was believed to be carboxylic acid functionalized polymer formed during the carbonylation of the ethylene-butene-1 copolymer due to the presence of some moisture, which acid was not converted to amide by the diamine under the reaction conditions employed. The product analyzed for 1.06 wt. % N.

Example 7

200 grams of the amidoamine ester of Example 6 were dissolved in a mixture of 100 ml of heptane and 10 ml of methanol. 6.2 grams of methyl acrylate were added, followed by stirring the reaction mixture at room temperature overnight. The reaction mixture was then treated under vacuum at 100° C. for 1 to 2 hours to remove the solvent. The treated product was found to have a nitrogen content of 1.02 wt. %. Carbon-13 NMR analysis determined that conversion to the desired product was greater than 90%.

Example 8

50 grams of the product of Example 7 was mixed with 33 grams of mineral oil solvent 150 neutral and 2.6 grams of Dow HA-2 polyamine. The mixture was heated for 8 hours at 150° C. An infrared spectrum of the mixture showed the complete disappearance of the ester band. The filtered product was found to have 1.27 wt. % N.

Example 9 (Comparative)

A portion of the 2,4-dichlorophenyl ester functionalized ethylene-butene-1 copolymer prepared in Example 1 was aminated with Dow HA-2 polyamine (32.8 wt. % nitrogen and an equivalent weight of 117) using a stoichiometry of 1.25 equivalents of primary amine per equivalent of ester by heating for 14 hours at 200° C. while applying a vacuum to remove the 2,4-dichlorophenol by-product. The product was diluted in base oil to produce an oil solution containing 45 wt. % dispersant. The diluted product had 0.79 wt. % N.

Example 10

A portion of the polymer ester prepared in Example 1 was mixed with triethylene tetramine in an amine to polymer mole ratio of 5:1, after which the mixture was heated at 200° C. An infrared spectrum of the reaction mixture showed the complete disappearance of the ester absorption bands and the appearance of a strong amide band after four hours at 200° C., indicating a complete conversion of the polymer ester to polymer amidoamine, which was primarily a 1:1 adduct of the polymer ester and the tetramine. The product was then stripped at 220° C. under vacuum (0.0013 kPa= 0.01 mm Hg) to remove the unreacted tetramine and 2,4-dichlorophenol by-product.

100 grams of this stripped first amidoamine product were dissolved in 70 grams of S150N mineral oil, followed by the addition of 20 ml of methanol. 1.8 grams of methyl acrylate was added (amidoamine product to acrylate mole ratio of 2:1) with stirring under a nitrogen blanket, and the mixture heated to 100° C. After six hours at 100° C., the resulting product was stripped with nitrogen at 120° C. for about 2 hours. The infrared absorption spectrum of the stripped product was consistent with the non-selective reaction of the methyl acrylate with the polymer amidoamine product, wherein the methyl acrylate acted to couple the polymer amidoamine chains. The oil solution of the stripped second amidoamine product had 0.83 wt. % N. The kinematic viscosity of the solution (50% AI) was 0.00036 $m^2$/sec (360 centistokes) at 100° C. (ASTM D445), versus 0.00021 $m^2$/sec (210 centistokes) for the stripped first amidoamine product.

Example 11

115.2 grams (1 equivalent of primary amino groups) of a mixture of ethylene polyamines having an average composition corresponding to 6 nitrogen atoms and 10 carbon atoms per molecule (33 wt. % N; 8.68 equivalents of primary amine per gram of amine) was dissolved in 100 ml of methanol, after which 86 grams (1 mole) of methyl acrylate was added at 10° C. over a one hour period while stirring under nitrogen. The reaction mixture was then stirred at room temperature for four hours and then stripped under vacuum at about 60° C. An infrared absorption spectrum of the stripped product showed strong ester absorption bands indicating the methyl acrylate reacted with the polyamines by a Michael addition. The stripped product was found to have 1.91 wt. % N.

4.6 grams of the stripped product were mixed with 100 grams of the product of Example 1 and heated to 120° C. under a nitrogen blanket. After six hours of heating, an infrared absorption spectrum of the mixture showed the complete disappearance of the ester band and the presence of a strong amide band. The product was then stripped with nitrogen at 120° C. for about 2 hours. The stripped product was found to have 0.70 wt. % N.

Example 12

Sludge Inhibition Tests

The dispersancy of the products of Examples 5, 8, and 9 were tested for sludge inhibition via the SIB test. In the SIB test, a dispersant is added to a clear, bright supernatant oil obtained from a used crankcase oil composition that has been used in a taxicab. The used crankcase contains a base mineral lubricating oil, a viscosity modifier, a pour point depressant and a zinc dialkyldithiophosphate anti-wear additive, but itself has no dispersant additive. This supernatant oil has been separated from the oil insoluble sludge precursors which on heating under the conditions of the SIB test tend to form additional oil-insoluble deposits. The sludge inhibition of the dispersant is then determined by heating the dispersant-oil blend in air for several hours and comparing the amount of sludge (in mg) formed in the blend to the amount formed by a similarly treated blank containing only the oil. SIB values are reported on a normalized scale of 1 (high inhibition) to 10 (no inhibition).

A more detailed description of the SIB test can be found in U.S. Pat. No. 4,954,572 and U.S. Pat. No. 5,271,856, both incorporated herein by reference in their entireties.

The results of the SIB test are presented below for Examples 5, 8 and 9. In each case, the dispersant was present in an amount providing 0.50 wt. % N. The results show that the products of the invention have useful sludge inhibiting properties.

| Example | SIB (mg) |
|---|---|
| 5 | 2.66 |
| 8 | 1.60 |
| 9 | 2.71 |

What is claimed is:

1. A process for preparing a product useful as an additive in fuels and lubricating oils comprising the steps of:

(A) reacting (i) a hydrocarbon polymer functionalized to contain functional groups of formula —CO—Y—$R^3$, the hydrocarbon polymer having a number average molecular weight of at least about 500 prior to functionalization, wherein Y is O or S, $R^3$ is hydrogen, hydrocarbyl, or substituted hydrocarbyl and wherein at least 50 mole % of the functional groups are attached to a tertiary carbon atom of the polymer, with (ii) a volatile amine containing at least two reactive amino groups under conditions effective to amidate at least a portion of the functional groups and form a first amidoamine adduct containing at least one reactive amino group; and (B) reacting the first amidoamine adduct with an α,β-unsaturated compound to form a second amidoamine adduct, wherein the α,β-unsaturated compound has the formula:

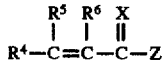

wherein X is O or S; Z is $OR^7$, —$SR^7$, or —$NR^7(R^8)$; and $R^4$, $R^5$, $R^6$, $R^7$ and $R^8$ are the same or different and are hydrogen, hydrocarbyl, or substituted hydrocarbyl.

2. The process according to claim 1, wherein the volatile amine is employed in an amount of at least one mole per equivalent of functional groups in the functionalized hydrocarbon polymer.

3. The process according to claim 1, wherein the α,β-unsaturated compound in step (B) is employed under conditions effective to selectively react at least a portion of the carbon—carbon double bonds in the α,β-unsaturated compound with the reactive amino groups in the first amidoamine adduct, such that the second amidoamine adduct is characterized by having unreacted —C(=X)Z functional groups.

4. The process according to claim 3, further comprising the step of reacting the second amidoamine adduct with a second amine under conditions effective to amidate at least a portion of the —C(=X)Z functional groups in the second amidoamine adduct.

5. The process according to claim 3, further comprising the step of reacting the second amidoamine adduct with an amidoaminated hydrocarbon polymer containing at least one reactive amino group and formed by reacting (i) another hydrocarbon polymer functionalized to contain functional groups of formula —CO—Y'—$R^{3'}$, said other hydrocarbon polymer having a number average molecular weight of at least about 500 prior to functionalization, wherein Y' is O or S; $R^{3'}$ is hydrogen, hydrocarbyl, or substituted hydrocarbyl; and wherein at least 50 mole % of the functional groups are attached to a tertiary carbon atom of the polymer, with (ii) another volatile amine containing at least two reactive amino groups under conditions effective to amidate at least a portion of the —C(=X)Z functional groups in the second amidoamine adduct.

6. The process according to claim 4, wherein the second amine comprises an alkylene polyamine having about 2 to 60 carbon atoms and about 2 to 12 nitrogen atoms per molecule.

7. The process according to claim 4, wherein the second amine comprises heavy alkylene polyamine.

8. A product useful as an additive in fuels and lubricating oils prepared by the process comprising the steps of:

(A) reacting (i) a hydrocarbon polymer functionalized to contain functional groups of formula —CO—Y—$R^3$, the hydrocarbon polymer having a number average molecular weight of at least about 500 prior to functionalization, wherein Y is O or S, $R^3$ is hydrogen, hydrocarbyl, or substituted hydrocarbyl and wherein at least 50 mole % of the functional groups are attached to a tertiary carbon atom of the polymer, with (ii) a volatile amine containing at least two reactive amino groups under conditions effective to amidate at least a portion of the functional groups and form a first amidoamine adduct containing at least one reactive amino group; and (B) reacting the first amidoamine adduct with an α,β-unsaturated compound to form a second amidoamine adduct, wherein the α,β-unsaturated compound has the formula:

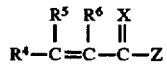

wherein X is O or S; Z is $OR^7$, —$SR^7$, or —$NR^7(R^8)$; and $R^4$, $R^5$, $R^6$, $R^7$ and $R^8$ are the same or different and are hydrogen, hydrocarbyl, or substituted hydrocarbyl; wherein the α,β-unsaturated compound is employed under conditions effective to selectively react at least a portion of the carbon—carbon double bonds in the α,β-unsaturated compound with the reactive amino groups in the first amidoamine adduct, such that the second amidoamine adduct is characterized by having unreacted —C(=X)Z functional groups.

9. The product according to claim 8, wherein the second amidoamine adduct is further reacted with a second amine, the second amine being different from the volatile amine of step (A)(ii), under conditions effective to amidate at least a portion of the —C(=X)Z functional groups in the second amidoamine adduct.

10. The product according to claim 8, wherein Y is O, and $R^3$ is selected from the group consisting of halophenyls and haloalkyls.

11. The product according to claim 8, wherein the hydrocarbon polymer comprises at least one member selected from the group consisting of ethylene α-olefin polymers derived from ethylene and at least one α-olefin of formula $H_2C{=}CHR^e$, α-olefin homopolymers derived from an α-olefin of formula $H_2C{=}CHR^e$, and α-olefin copolymers derived from at least two α-olefins of formula $H_2C{=}CHR^e$, wherein $R^e$ is a straight or branched chain alkyl radical comprising 1 to 18 carbon atoms.

12. The product according to claim 11, wherein at least about 30% of the polymer chains of the hydrocarbon polymer possess terminal vinylidene unsaturation.

13. The product according to claim 8, wherein the hydrocarbon polymer has a number average molecular weight in the range of from about 500 to 20,000.

14. The product according to claim 8, wherein the volatile amine comprises an amine containing at least two primary amino groups.

15. The product according to claim 14, wherein the volatile amine is selected from the group consisting of 1,3-diaminopropane, 1,2-diaminopropane, 1,4-diaminobutane, hexamethylene diamine, decamethylenediamine, 1,4-diaminocyclohexane, and the $N_2$ to $N_6$ ethylene polyamines.

16. The product according to claim 8, wherein X is O and Z is $—OR^7$ in the α,β-unsaturated compound.

17. The product according to claim 16, wherein the α,β-unsaturated compound comprises an acrylic ester compound selected from the group consisting of methyl acrylate, ethyl acrylate, propyl acrylate, butyl acrylate, methyl methacrylate, ethyl methacrylate, propyl methacrylate, and butyl methacrylate.

18. The product according to claim 9, wherein the second amine comprises an alkylene polyamine having about 2 to 60 carbon atoms and about 2 to 12 nitrogen atoms per molecule.

19. The product according to claim 9, wherein the second amine comprises heavy alkylene polyamine.

20. The product according to claim 9 wherein the product is post-treated with a borating agent to obtain a borated product containing at least about 0.01 weight percent boron.

21. A lubricating oil composition comprising about 0.01 to 20 weight percent of the product of claim 8.

22. A lubricating oil composition prepared by blending a base oil with about 0.01 to weight percent of the product of claim 8.

23. A lubricating oil concentrate comprising about 20 to 60 weight percent of the product of claim 8.

24. A lubricating oil concentrate prepared by blending a diluent with about 20 to 60 weight percent of the product of claim 8.

25. The product according to claim 8, wherein the second amidoamine adduct is further reacted with a second amine containing at least two reactive amino groups under conditions effective to amidate at least a portion of the —C(=X)Z functional groups in the second amidoamine adduct and to form coupled or extended adducts.

26. A lubricating oil composition comprising about 0.01 to 20 weight percent of the product of claim 9.

27. A lubricating oil composition prepared by blending a base oil with about 0.01 to 20 weight percent of the product of claim 9.

28. A lubricating oil concentrate comprising about 20 to 60 weight percent of the product of claim 9.

29. A lubricating oil concentrate prepared by blending a base oil with about 20 to 60 weight percent of the product of claim 9.

30. A process for preparing a product useful as an additive in fuels and lubricating oils comprising the steps of:

(A) reacting (i) a hydrocarbon polymer functionalized to contain functional groups of formula $—CO—Y—R^3$, the hydrocarbon polymer having a number average molecular weight of at least about 500 prior to functionalization, wherein Y is O or S, $R^3$ is hydrogen, hydrocarbyl, or substituted hydrocarbyl and wherein at least 50 mole % of the functional groups are attached to a tertiary carbon atom of the polymer, with (ii) a volatile amine containing at least two reactive amino groups under conditions effective to amidate at least a portion of the $—CO—Y—R^3$ functional groups and form a first amidoamine adduct containing at least one reactive amino group; and (B) reacting the first amidoamine adduct of step (A) with another amidoamine adduct formed by reacting (i) an α,β-unsaturated compound of formula:

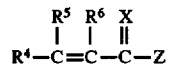

wherein X is O or S; Z is $OR^7$, $—SR^7$, or $—NR^7(R^8)$; and $R^4$, $R^5$, $R^6$, $R^7$ and $R^8$ are the same or different and are hydrogen, hydrocarbyl, or substituted hydrocarbyl; and (ii) a polyamine having at least two reactive amino groups selected from the group consisting of primary amino groups, secondary amino groups, and mixtures thereof, under conditions effective to selectively react at least a portion of the carbon—carbon double bonds in the α,β-unsaturated compound with the reactive amino groups in the polyamine, such that the other amidoamine adduct is characterized by having unreacted —C(=X)Z functional groups; wherein the first amidoamine adduct is reacted with the other amidoamine adduct under conditions effective to amidate at least a portion of the —C(=X)Z functional groups.

31. A product useful as an additive in fuels and lubricating oils prepared by the process of claim 30.

* * * * *

UNITED STATES PATENT AND TRADEMARK OFFICE

CERTIFICATE OF CORRECTION

PATENT NO. : 5,672,573

DATED : Sept. 30, 1997

INVENTOR(S) : Antonio Gutierrez, James P. Stokes

It is certified that error appears in the above-identified patent and that said Letters Patent is hereby corrected as shown below:

In the title, delete "AMICLOAMINE" and insert --AMIDOAMINE--.

In column 35, claim 22, line 2, after "to" insert --20--.

Signed and Sealed this

Twenty-fourth Day of February, 1998

*Attest:*

Bruce Lehman

BRUCE LEHMAN

*Attesting Officer*

*Commissioner of Patents and Trademarks*